US012196067B1

(12) United States Patent
Yeung et al.

(10) Patent No.: US 12,196,067 B1
(45) Date of Patent: Jan. 14, 2025

(54) HYDRAULIC FRACTURING ARRANGEMENT AND BLENDING SYSTEM

(71) Applicant: BJ Energy Solutions, LLC, Houston, TX (US)

(72) Inventors: Tony Yeung, Houston, TX (US); Nicholas Tew, Houston, TX (US); William Nieuwenburg, Houston, TX (US)

(73) Assignee: BJ Energy Solutions, LLC, The Woodlands, TX (US)

( * ) Notice: Subject to any disclaimer, the term of this patent is extended or adjusted under 35 U.S.C. 154(b) by 0 days.

(21) Appl. No.: 18/336,480

(22) Filed: Jun. 16, 2023

(51) Int. Cl.
*E21B 43/12* (2006.01)
*E21B 43/26* (2006.01)

(52) U.S. Cl.
CPC ..... *E21B 43/2607* (2020.05); *E21B 43/12* (2013.01)

(58) Field of Classification Search
CPC ..... E21B 43/12; E21B 43/26; E21B 43/2607
See application file for complete search history.

(56) References Cited

U.S. PATENT DOCUMENTS 2,427,638 A 9/1947 Vilter et al.
2,572,711 A 10/1951 Fischer
2,956,738 A 10/1960 Af et al.
3,401,873 A 9/1968 Privon et al.
3,692,434 A 9/1972 Schnear
4,050,862 A 9/1977 Buse
4,159,180 A 6/1979 Cooper et al.
4,311,395 A 1/1982 Douthitt et al.
4,460,276 A 7/1984 Arribau et al.
4,538,222 A 8/1985 Crain et al.
4,779,186 A 10/1988 Handke et al.
4,854,714 A 8/1989 Davis et al.
5,032,065 A 7/1991 Yamamuro et al.
5,167,493 A 12/1992 Kobari
5,441,340 A 8/1995 Cedillo et al.
5,634,777 A 6/1997 Albertin et al.
6,007,227 A 12/1999 Carlson
6,193,402 B1 * 2/2001 Grimland ..... E21B 43/2607 366/14
6,401,472 B2 6/2002 Pollrich et al.
6,644,844 B2 * 11/2003 Neal ..... B01F 23/53 366/27
6,669,453 B1 12/2003 Breeden et al.
7,281,519 B2 10/2007 Schroeder et al.
7,524,173 B2 4/2009 Cummins
7,686,499 B2 3/2010 Dykstra et al.
(Continued)

FOREIGN PATENT DOCUMENTS

CN 201275801 Y 7/2009
CN 102562020 A 7/2012
(Continued)

*Primary Examiner* — Matthew R Buck
(74) *Attorney, Agent, or Firm* — Norton Rose Fulbright US LLP

(57) ABSTRACT

A hydraulic fracturing system for blending liquid and solid particulates together to prepare a fracturing fluid, the system can include a plurality of independently operable blender units. In some aspects the blender units can operate with different sand concentrations in a split stream operation. In further aspects, a pump can be operated with the blender units to provide multiple fluid sources for a fleet of fracturing pumpers.

21 Claims, 14 Drawing Sheets

(56) References Cited

U.S. PATENT DOCUMENTS

| | | | | |
|---|---|---|---|---|
| 8,388,317 | B2 | 3/2013 | Sung | |
| 8,500,215 | B2 | 8/2013 | Gastauer et al. | |
| 8,641,399 | B2 | 2/2014 | Mucibabic et al. | |
| 9,103,193 | B2 | 8/2015 | Coli et al. | |
| 9,175,530 | B2 | 11/2015 | Eia et al. | |
| 9,475,020 | B2 | 10/2016 | Coli et al. | |
| 9,475,021 | B2 | 10/2016 | Coli et al. | |
| 9,644,795 | B2 | 5/2017 | Burette | |
| 9,970,278 | B2 | 5/2018 | Broussard et al. | |
| 10,107,085 | B2 * | 10/2018 | Coli | B01F 35/3204 |
| 10,221,668 | B2 * | 3/2019 | Coli | F04B 47/02 |
| 10,227,855 | B2 | 3/2019 | Coli et al. | |
| 10,246,984 | B2 | 4/2019 | Payne et al. | |
| 10,300,830 | B2 | 5/2019 | McIver et al. | |
| 10,406,962 | B2 | 9/2019 | Hughes et al. | |
| 10,407,990 | B2 | 9/2019 | Oehring et al. | |
| 10,408,031 | B2 | 9/2019 | Oehring et al. | |
| RE47,695 | E | 11/2019 | Case et al. | |
| 10,478,753 | B1 | 11/2019 | Elms et al. | |
| 10,502,042 | B2 | 12/2019 | Coli et al. | |
| 10,625,654 | B2 | 4/2020 | Hughes et al. | |
| 10,675,601 | B2 | 6/2020 | Fisher | |
| 10,738,928 | B2 | 8/2020 | Arizpe et al. | |
| 10,774,630 | B2 | 9/2020 | Coli et al. | |
| 10,808,512 | B2 | 10/2020 | Koricanek | |
| 10,836,568 | B2 | 11/2020 | Managan, II et al. | |
| 10,851,634 | B2 | 12/2020 | Coli et al. | |
| 10,851,638 | B2 | 12/2020 | Payne et al. | |
| 10,865,624 | B1 | 12/2020 | Cui et al. | |
| 10,876,386 | B2 | 12/2020 | Coli et al. | |
| 11,015,423 | B1 | 5/2021 | Yeung et al. | |
| 11,066,915 | B1 | 7/2021 | Yeung et al. | |
| 11,085,281 | B1 | 8/2021 | Yeung et al. | |
| 11,091,992 | B2 | 8/2021 | Broussard et al. | |
| 11,148,106 | B2 | 10/2021 | Liu et al. | |
| 11,149,533 | B1 | 10/2021 | Yeung et al. | |
| 11,168,681 | B2 | 11/2021 | Boguski et al. | |
| 11,193,360 | B1 | 12/2021 | Yeung et al. | |
| 11,193,361 | B1 | 12/2021 | Yeung et al. | |
| 11,203,924 | B2 | 12/2021 | Oehring et al. | |
| 11,208,881 | B1 | 12/2021 | Yeung et al. | |
| 11,255,173 | B2 * | 2/2022 | Coli | B01F 35/71 |
| 11,261,717 | B2 | 3/2022 | Yeung et al. | |
| 11,274,537 | B2 | 3/2022 | Yeung et al. | |
| 11,299,971 | B2 | 4/2022 | Yeung et al. | |
| 11,319,791 | B2 | 5/2022 | Yeung et al. | |
| 11,339,638 | B1 | 5/2022 | Yeung et al. | |
| 11,391,137 | B2 | 7/2022 | Yeung et al. | |
| 11,396,799 | B2 | 7/2022 | Johnson et al. | |
| 11,506,032 | B1 * | 11/2022 | Fisher | E21B 43/2607 |
| 2007/0098580 | A1 | 5/2007 | Petersen | |
| 2012/0023973 | A1 | 2/2012 | Mayorca | |
| 2014/0096974 | A1 | 4/2014 | Coli et al. | |
| 2016/0032703 | A1 | 2/2016 | Broussard et al. | |
| 2016/0258267 | A1 | 9/2016 | Payne et al. | |
| 2017/0036178 | A1 | 2/2017 | Coli et al. | |
| 2018/0258746 | A1 | 9/2018 | Broussard et al. | |
| 2019/0003272 | A1 | 1/2019 | Morris et al. | |
| 2019/0009232 | A1 | 1/2019 | Yeung | |
| 2019/0112910 | A1 | 4/2019 | Oehring et al. | |
| 2019/0226317 | A1 | 7/2019 | Payne et al. | |
| 2020/0141219 | A1 | 5/2020 | Oehring et al. | |
| 2021/0131410 | A1 | 5/2021 | Curry et al. | |
| 2021/0148385 | A1 | 5/2021 | Brunty et al. | |
| 2021/0148500 | A1 | 5/2021 | Farquharson et al. | |
| 2021/0381929 | A1 | 12/2021 | Yeung et al. | |
| 2021/0396116 | A1 | 12/2021 | Yeung et al. | |
| 2021/0396222 | A1 | 12/2021 | Yeung et al. | |
| 2024/0018859 | A1 * | 1/2024 | Sun | F04B 49/065 |
| 2024/0026763 | A1 * | 1/2024 | Sun | E21B 43/2607 |
| 2024/0026764 | A1 * | 1/2024 | Sun | E21B 43/2607 |

FOREIGN PATENT DOCUMENTS

| | | | |
|---|---|---|---|
| CN | 202895467 | U | 4/2013 |
| CN | 104563994 | B | 3/2017 |
| CN | 104563995 | B | 9/2017 |
| WO | 8103143 | A1 | 11/1981 |
| WO | 2022115511 | A1 | 6/2022 |

* cited by examiner

HYDRAULIC FRACTURING ARRANGEMENT AND BLENDING SYSTEM

TECHNICAL FIELD

The present disclosure relates to systems and methods for fracturing operations and preparing fluids used in fracturing operations, and more particularly, to blenders for mixing liquid and solid particles to prepare a fracturing fluid.

BACKGROUND

Fracturing is an oilfield operation that stimulates production of hydrocarbons, such that the hydrocarbons may more easily or readily flow from a subsurface formation to a well. For example, a fracturing system may be configured to fracture a formation by pumping a fracturing fluid into a well at high pressure and high flow rates. Some fracturing fluids may take the form of a slurry including water, proppants, and/or other additives, such as thickening agents and/or gels. The slurry may be forced via one or more pumps into the formation at rates faster than can be accepted by the existing pores, fractures, faults, or other spaces within the formation. As a result, pressure builds rapidly to the point where the formation may fail and may begin to fracture. By continuing to pump the fracturing fluid into the formation, existing fractures in the formation are caused to expand and extend in directions farther away from a well bore, thereby creating flow paths to the well bore. The proppants may serve to prevent the expanded fractures from closing when pumping of the fracturing fluid is ceased or may reduce the extent to which the expanded fractures contract when pumping of the fracturing fluid is ceased. Once the formation is fractured, large quantities of the injected fracturing fluid are allowed to flow out of the well, and the production stream of hydrocarbons may be obtained from the formation.

Systems for successfully completing a fracturing operation can be extensive and complex, as shown in FIG. 1, for example. Water from tanks 1 and gelling agents dispensed by a chemical unit 2 are mixed in a hydration unit 3. The discharge from hydration unit 3, along with sand carried on conveyors 4 from sand tanks 5, is fed into a blending unit 6. Blending unit 6 mixes the gelled water and sand into a slurry. The slurry is discharged through low-pressure hoses 7 which convey it into two or more low-pressure lines 8 in a frac manifold 9. The low-pressure lines 8 in frac manifold 9 feed the slurry to an array of pumps 10, perhaps as many as a dozen or more, through low-pressure "suction" hoses 11. The chemical unit 2, hydration unit 3 and blending unit 6 may be mounted on a trailer that may be transported by trucks.

Pumps 10 take the slurry and discharge it at high pressure through individual high-pressure "discharge" lines 12 into two or more high-pressure lines or "missiles" on frac manifold 9. Missiles flow together, i.e., they are manifolded on frac manifold 9. Several high-pressure flow lines 14 run from the manifolded missiles to a "goat head" 15. Goat head 15 delivers the slurry into a "zipper" manifold 16 (also referred to by some as a "frac manifold"). Zipper manifold 16 allows the slurry to be selectively diverted to, for example, one of two well heads 17. Once fracturing is complete, flow back from the fracturing operation discharges into a flowback manifold 18 which leads into flowback tanks 19.

Typically, hydraulic fracturing blenders utilize a single suction pump, tub, and discharge pump. If one of the components has a failure, the entire blender must be shut down and, in turn, the entire fracturing operation. This may lead to costly downtime and even cause the well to be sanded. This occurs when the operation cannot flush the well and sand is left in the wellbore. If enough sand is left in the wellbore, fracturing operations cannot continue until the sand is flushed out using coiled tubing or a service rig. A drop in the boost pressure in the pumps also may cause cavitation, which may lead to failures such as fluid end cracking and power failure.

SUMMARY

The present disclosure generally is directed to configurations of multi-blender systems that include a plurality of independently operable blender units each having components that can operate with either blender unit. The multi-blender systems can operate with separate pumps, such as centrifugal pumps, to provide a plurality of operational states for each pump within a fleet of pumps or within multiple fleets of pumps, such as during simultaneous hydraulic fracturing operations. In some of the disclosed configurations, the multi-blender system can segment a fleet of pumps into clean pumps, which receive a clean stream having a minimal amount of solids, and dirty pumps, which receive a dirty stream having solid particulates, to increase the useful life of the fleet. In configurations in which a pump is configured to receive multiple, fluids the disclosed system can segment a single pump into clean cylinder and dirty cylinders to increase the useful life of the pump. Some of the disclosed configurations provide enhanced control of fluid delivery to source and can provide control of fluid properties, such as density and sand concentration, downstream of the blender.

Some aspects of the present disclosure can include a hydraulic fracturing system that includes a blender having a first blender unit configured to be in communication with a fleet of pumpers and a second blender unit configured to be in communication with the fleet of pumpers and a pump configured to deliver a third fluid to the fleet of pumpers. In some configurations, at least one pumper of the fleet of pumpers is configured to be in fluid communication with at least two of: first blender unit, second blender unit, or pump. The first blender unit can include a first tub having a first mixer configured to mix fluid and solid particulates, a first suction pump configured to deliver fluid to the first tub, and a first discharge pump configured to draw a first fluid from the first tub. Additionally, or alternatively, the second blender unit can include a second tub having a second mixer configured to mix fluid and solid particulates, a second suction pump configured to deliver fluid to the second tub, and a second discharge pump configured to draw a second fluid from the second tub. In some configurations, the first blender unit and the second blender unit are disposed on the same trailer.

Some of the disclosed systems can include a plurality of crossover lines configured to provide selective fluid communication between the first blender unit and the second blender unit such that the second discharge pump is configured to draw the second fluid from the second tub and the first discharge pump is configured to draw the first fluid from the first tub. In some configurations, the first fluid from the first blender unit and the third fluid from the pump are configured to be mixed prior before being received at the at least one pumper. The system can include a first proppant transport system configured to deliver proppant to the first tub, a second proppant transport system configured to deliver proppant to the second tub, one or more water tanks configured to deliver water to the pump, or combination thereof.

In some aspects, the system can include a controller configured to be in communication with the first blender unit, second blender unit, and pump. The controller can be configured to operate the system in a first state in which the first blender unit delivers the first fluid to a first set of pumpers of the fleet of pumpers, the second blender unit delivers the second fluid to a second set of pumpers of the fleet of pumpers, and the pump delivers the third fluid to a third set of pumpers of the fleet of pumpers. In some such configurations, the first fluid includes solid particulates, and the second fluid and the third fluid are clean fluids substantially free of solid particulates. In some aspects, based on a failure, the controller is configured to operate the system in a second state in which the second blender unit delivers a fourth fluid having solid particulates to at least one of the second set of pumpers, the pump delivers the third fluid to the third set of pumpers.

Some of the disclosed configurations include the fleet of pumpers fluidly connected to a first well and a fleet of second pumpers fluidly connected to a second well. In such configurations, the second blender unit and the pump can be configured to be in communication with the fleet of second pumpers. The controller can be configured to operate the system in a third state in which the first blender unit delivers the first fluid to a first set of pumpers of the fleet of pumpers, the pump delivers the third fluid to a second set of pumpers of the fleet of pumpers, the second blender unit delivers the second fluid to a first set of pumpers of the fleet of second pumpers, and the pump delivers the third fluid to a second set of pumpers of the fleet of second pumpers. In some such configurations, the first fluid and the second fluid include solid particulates and the third fluid is a clean fluid substantially free of solid particulates. In some aspects, based on a failure, the controller is configured to operate the system in a fourth state in which the second blender unit delivers the second fluid to the first set of pumpers of the fleet of pumpers and the first set of pumpers of the fleet of second pumpers. In some of the systems disclosed herein, the pump can include one or more centrifugal pumps. Some of the disclosed systems can include a pumper having a first set of plungers associated with the first fluid end and a second set of plungers associated with the second fluid end, wherein the first set of plungers have a stroke length less than a stroke length of the second set of plungers.

Some of the disclosed aspects include a method for blending liquid and solid particulates together in a split streaming operation, a simultaneous fracturing operation, or both. Some of the methods can include operating a blender in a first state, operating a pump in a first state, and switching an operation state of the blender from the first state to a second state. In some such methods, operating the blender in the first state may include pumping a first fluid through a first blender unit to a first set of pumpers; the first blender unit having a first tub mixer, a first discharge pump, and a plurality of first discharge ports and pumping a second fluid through a first blender unit to a first set of pumpers; the first blender unit having a first tub mixer, a first discharge pump, and a plurality of first discharge ports. In the first state, the first fluid may not be pumped through the second blending unit. In some such methods, operating the pump in the first state can include pumping a third fluid to the second set of pumpers or to a third set of pumpers. Operating the blender in the second state may include pumping the first fluid to at least one pumper of the second set of pumpers or third set of pumpers.

In some methods the first fluid includes a mixing fluid and solid particulates, and the second and third fluids are substantially free of solid particulates. In some of the disclosed configurations, while the blender is in the second state, the method can include pumping the first fluid from the first tub mixer, to the second discharge pump, and to the plurality of second discharge ports. The first set of pumpers can be connected to a first well and the second set of pumpers can be connected to a second well. In other configurations, the first set of pumpers and the second set of pumpers are connected to a first well. In some methods, the pump includes one or more centrifugal pumps.

Some aspects of the present disclosure can include a blender, a centrifugal pump, and a pumper. The blender can include a first blender unit and a second blender unit disposed on a platform. The first blender unit may include a first tub having a first mixer configured to mix fluid and solid particulates, a first suction pump configured to deliver fluid to the first tub, a first discharge pump configured to draw a first fluid from the first tub, or combination thereof. The second blender unit may include a second tub having a second mixer configured to mix fluid and solid particulates, a second suction pump configured to deliver fluid to the second tub, a second discharge pump configured to draw a second fluid from the second tub. In some of the disclosed configurations, the centrifugal pump configured to pump a third fluid and the pumper may include a first fluid end and a second fluid end. In some such configurations, the first fluid end is in fluid communication with the first blender unit and the second fluid end is in fluid communication with the second blender unit or the centrifugal pump. The system can include a first set of plungers associated with the first fluid end and a second set of plungers associated with the second fluid end. In some aspects, the first set of plungers have a stroke length less than a stroke length of the second set of plungers.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" or "approximately" is defined as largely but not necessarily wholly what is specified (and includes what is specified; e.g., substantially 90 degrees includes 90 degrees and substantially parallel includes parallel), as understood by a person of ordinary skill in the art. In any disclosed configuration, the term "substantially" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, something that "comprises," "has," "includes," or "contains" one or more elements possesses those one or more elements but is not limited to possessing only those one or more elements. Likewise, a method that "comprises," "has," "includes," or "contains" one or more steps possesses those one or more steps but is not limited to possessing only those one or more steps.

Furthermore, all numerical ranges herein should be understood to include all integers, whole or fractions, within the range, inclusive of the ends of the ranges. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth. Additionally, the use of between when describing two endpoints of a numerical range should be understood to include those endpoints. For example, a disclosure of between 1 to 10 should be construed as supporting a range including 1 and including 10.

Herein, "or" is inclusive and not exclusive, unless expressly indicated otherwise or indicated otherwise by context, and can have the same meaning as "and/or." Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Any configuration of any of the apparatuses, systems, and methods can consist of or consist essentially of—rather than comprise/include/have—any of the described steps, elements, or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one configuration may be applied to other configurations, even though not described, or illustrated, unless expressly prohibited by this disclosure or the nature of the configurations. Further, an apparatus or system that is configured in a certain way is configured in at least that way, but it can also be configured in other ways than those specifically described. Some details associated with the configurations described above and others are described below.

Additional features and advantages of the disclosed method and apparatus are described in, and will be apparent from, the following Detailed Description and the Figures. The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

DETAILED DESCRIPTION

Figure 1:
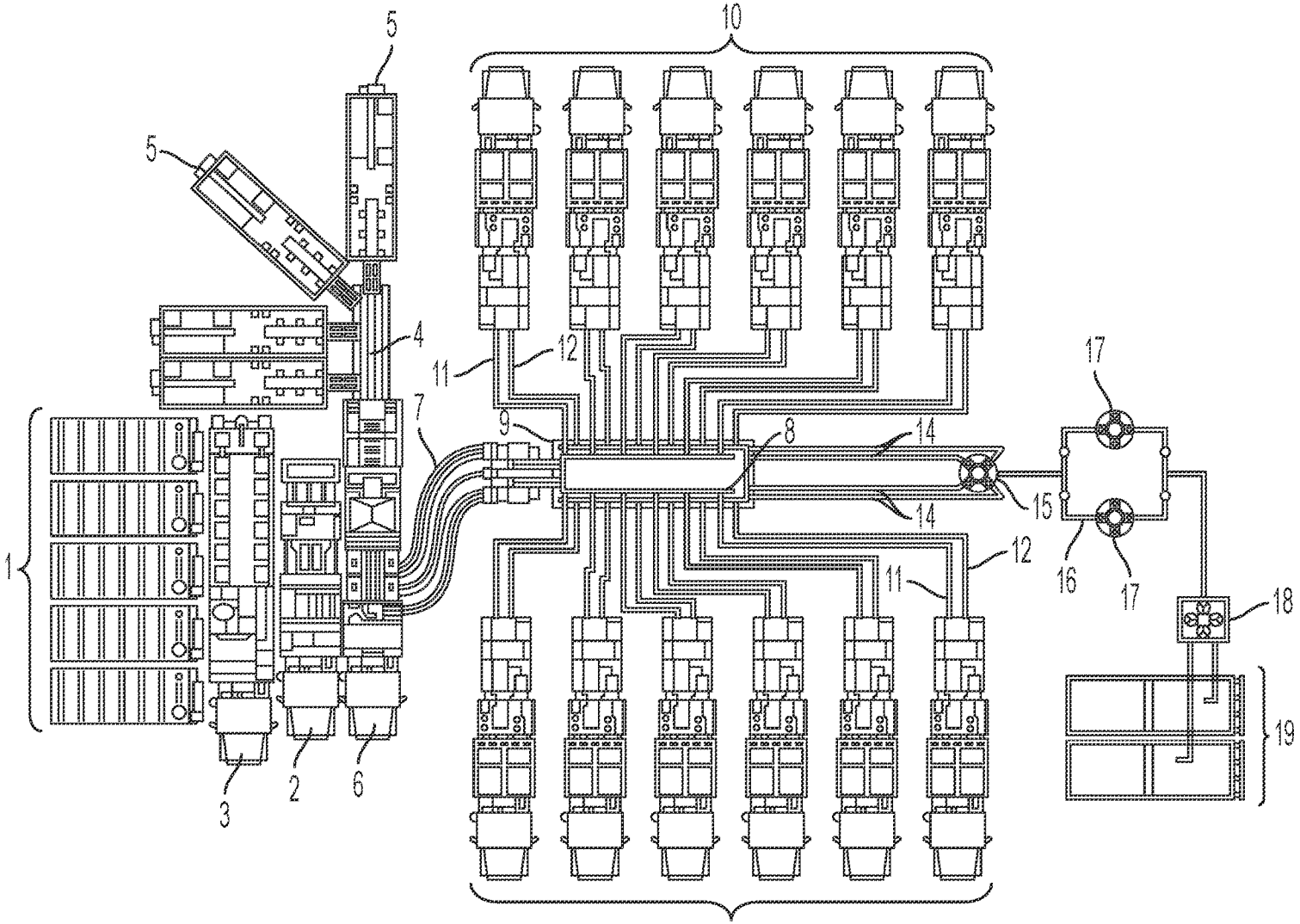
FIG. 1 PRIOR ART
FIG. 1 shows a schematic view of a system for fracturing a well including a conventional blender and pumps according to the prior art.

The present disclosure will now be described more fully hereinafter with reference to example configurations thereof with reference to the drawings in which like reference numerals designate identical or corresponding elements in each of the several views. These example configurations are described so that this disclosure will be thorough and complete and will fully convey the scope of the disclosure to those skilled in the art. Features from one configuration or aspect may be combined with features from any other configuration or aspect in any appropriate combination. For example, any individual or collective features of method aspects or configurations may be applied to apparatus, product, or component aspects or configurations and vice versa. The disclosure may be embodied in many different forms and should not be construed as limited to the configurations set forth herein; rather, these configurations are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Figure 2A:
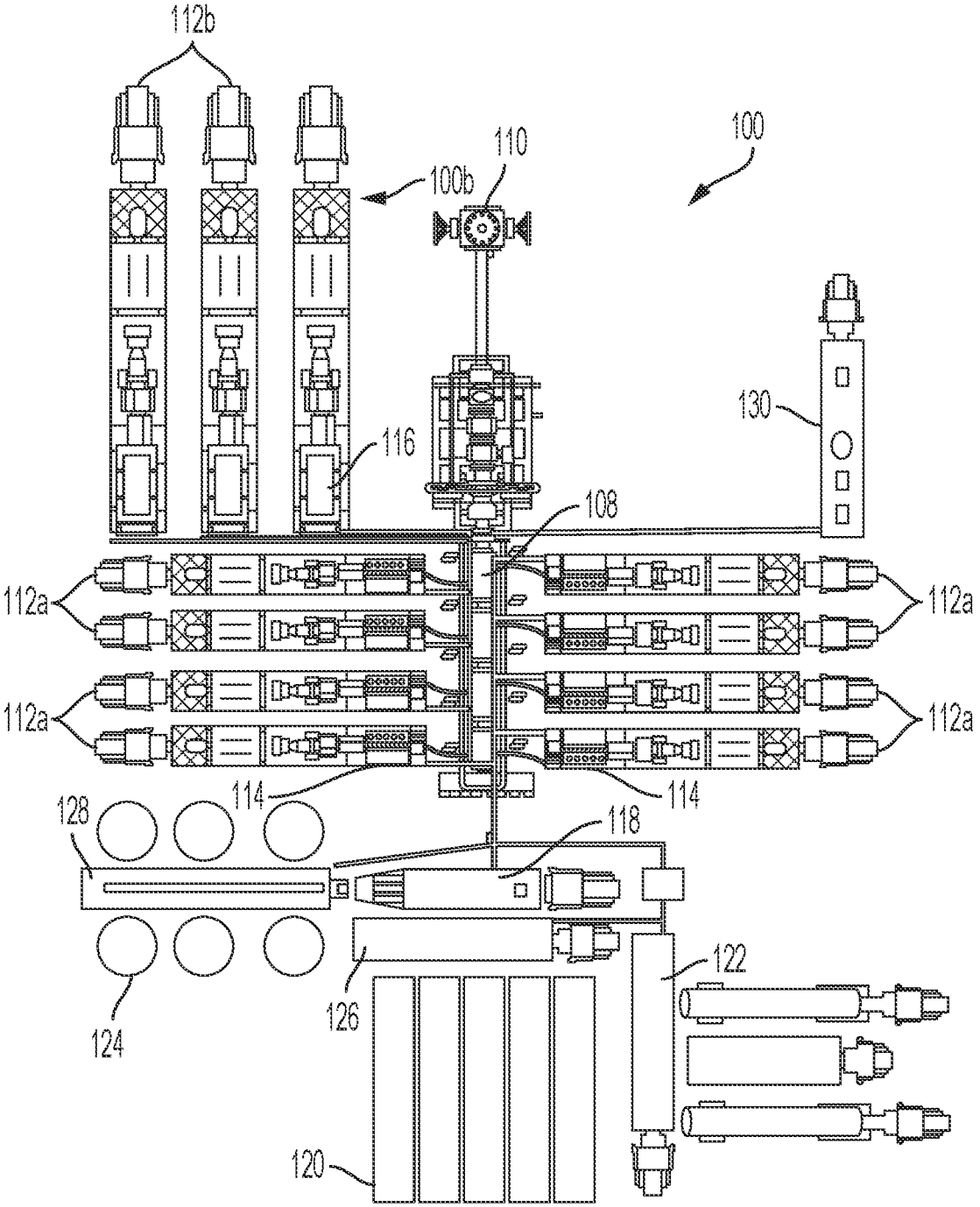
FIG. 2A shows a view of a wellsite hydraulic fracturing system according to an example of the present disclosure.

Referring now to FIG. 2A, a wellsite hydraulic fracturing pumper system 100 is shown. The wellsite hydraulic fracturing pumper system 100 can includes a plurality of mobile power units 112*a* arranged around a wellhead 110 to supply the wellhead 110 with high-pressure fracturing fluids as will be understood by those skilled in the art. Mobile power units 112*a* can drive one or more hydraulic fracturing pumps 114 that discharge high pressure fluid to a manifold 108 such that the high pressure fluid is provided to the wellhead 110.

Fracturing pumps 114 may be suitable for pumping any one or more fluid(s) for hydraulic fracturing. In some configurations, the pumps 114 are capable of providing a higher pumping capacity while still having physical dimensions enabling transportation of the mobile power units 112*a* including the hydraulic fracturing pump on public highways. Each of the hydraulic fracturing pumps 114 can be driven by a prime mover, such as a gas turbine engine, electric motor, internal combustion engine (e.g., diesel engine), or the like.

In some configurations, the wellsite hydraulic fracturing pumper system 100 can include a plurality of mobile power units 112*b* also arranged around or proximate to the wellhead 110. The mobile power units 112*b* can drive an electrical generator 116 that provides electrical power to the wellsite hydraulic fracturing pumper system 100. In other configurations, such as configurations which require a combustible fuel, mobile power units 112*b* can include one or more fuel supplies for supplying the prime movers and any other fuel-powered components of the hydraulic fracturing system 100, such as auxiliary equipment, with fuel. The fuel supplies may include gaseous fuels, such as compressed natural gas (CNG), natural gas, field gas, pipeline gas, methane, propane, butane, and/or liquid fuels, such as, for example, diesel fuel (e.g., #2 diesel), bio-diesel fuel, biofuel, alcohol, gasoline, gasohol, aviation fuel, and other fuels as will be understood by those skilled in the art. In some such configurations, electrical power can be generated or be delivered by other sources (e.g., power grids) known in the art.

As shown in FIG. 2A, a blender 118 can provide a flow of fluid to the fracturing pumps 114 which is pressurized by and discharged from the fracturing pumps into the manifold 108. Blender 118 can include one or more prime movers (e.g., electric motors) that are configured to power pumps that convey fluid or fluid mixtures to and from the blender. In some configurations, system 100 may include one or more water tanks 120 for supplying water for fracturing fluid, one or more chemical additive units 122 for supplying gels or agents for adding to the fracturing fluid, one or more proppant tanks 124 (e.g., sand tanks) for supplying proppants for the fracturing fluid, or combination thereof. Some configurations of system 100 can include a hydration unit 126 for mixing water from the water tanks 120 and gels and/or agents from the chemical additive units 122 to form a mixture, for example, gelled water. System 100 can also include a one or more proppant transport system 128, such as screw conveyors, conveyor belts, sand augers, or the like, that deliver the proppant from proppant tanks 124.

In operation, blender 118 can receive a fluid, such as from hydration unit 126, and solid particles, such as proppants via proppant transport system 128. Blender 118 may mix the fluid (or fluid mixture) and the proppants into a slurry to serve as fracturing fluid for hydraulic fracturing system 100. Once combined, the slurry may be discharged through low-pressure hoses, which convey the slurry into low-pressure lines in fracturing manifold 108. In the example shown, the low-pressure lines in the fracturing manifold 108 may feed the slurry to the hydraulic fracturing pumps 114 through low-pressure suction hoses as will be understood by those skilled in the art. Fracturing pumps 114 discharge the slurry (e.g., the fracturing fluid including the water, agents, gels, and/or proppants) at high flow rates and/or high pressures to fracturing manifold 108 and, in some configurations, the fracturing pumps may discharge the slurry through individual high-pressure discharge lines into two or more high-pressure flow lines, sometimes referred to as "missiles." The fluid can then be delivered from the fracturing manifold 108 into the wellhead 110, such as via a wellhead manifold or wellhead assembly as is understood in the art.

The wellsite hydraulic fracturing pumper system 100 can include a supervisory control unit that monitors and controls operation of the mobile power units 112*a* driving the fracturing pumps 114, the mobile power units 112*b* driving electrical generators 116, the blender 118, or other units, and may be referred to generally as controller 130. Although described as a single controller, controller 130 can include a plurality of distinct controllers (e.g., processors, memories, transceivers, and the like) cooperating together to perform the functions described herein. For example, controller 130 may be a mobile control unit in the form of a trailer or a van, as appreciated by those skilled in the art. In some configurations, all of the hydraulic fracturing pumps 114 are controlled by the controller 130 such that to an operator of the controller, the hydraulic fracturing pumps are controlled as a single pump or pumping system; however, in other configurations, the fracturing pumps 114 can be controlled individually or in any other manner disclosed in the art. Further details regarding the supervisory control unit are disclosed in U.S. application Ser. No. 17/182,408 filed on Feb. 23, 2021, and U.S. application Ser. No. 17/189,397 filed on Mar. 2, 2021, which are hereby incorporated by reference in their entireties.

Figure 2B:
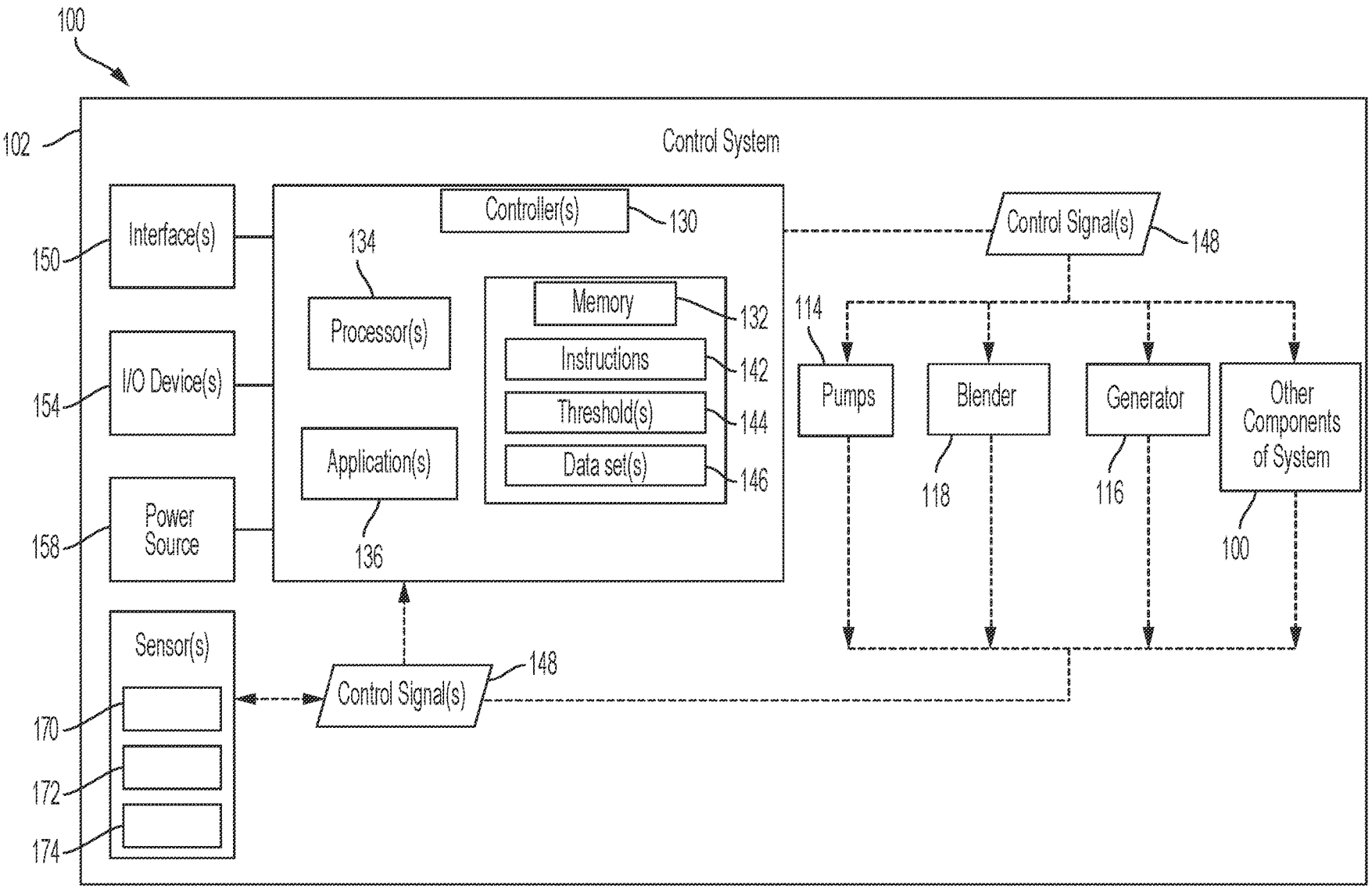
FIG. 2B shows a schematic view of a control system of the wellsite hydraulic fracturing system of FIG. 2A.

FIG. 2B illustrates a schematic of a control system for the wellsite hydraulic fracturing pumper system 100 referred to generally as a control system 102. As depicted, control system 102 can include controller 130 which is configured to control one or more operations of system 100, such as, but not limited to, operation of the flow of fluid and other materials through blender 118, pumps 114, or the like, such as operation of inlets or outlets, monitoring of flow parameters, fluid compositions, or the like (e.g., via sensors or other controllers), or combination thereof.

Controller 130 may include a processor 134 coupled to a memory 132 (e.g., a computer-readable storage device). In some configurations, controller 130 may include one or more application(s) 136 that access processor 134 and/or memory 132 to perform one or more operations of system 100. Processor 134 may include or correspond to a microcontroller/microprocessor, a central processing unit (CPU), a field-programmable gate array (FPGA) device, an application-specific integrated circuits (ASIC), another hardware device, a firmware device, or any combination thereof. Memory 132, such as a non-transitory computer-readable storage medium, may include volatile memory devices (e.g., random access memory (RAM) devices), nonvolatile memory devices (e.g., read only memory (ROM) devices, programmable read-only memory, and flash memory), or both. Memory 132 may be configured to store instructions 142, one or more thresholds 144, one or more data sets 146, or combination thereof. In some configurations, instructions 142 (e.g., control logic) may be configured to, when executed by the one or more processors 134, cause the processor(s) to perform one or more operations (e.g., actuate valves based on inputs and outputs of the vessels). The one or more thresholds 144 and one or more data sets 146 may be configured to cause the processor(s) to generate control signals (e.g., 148). For example, the processor(s) 134 may initiate and/or perform operations as described herein. As a specific example, thresholds can include a volume level of a tub, a concentration of a material (e.g., sand, chemical, additive, or the like) within the fluid, a time, a pressure, a temperature, a flow rate, or other fluid parameter within the system, pump rpm (e.g., maximum or minimum allowable rotational rate), prime mover rpm, screen out threshold, or other thresholds. Data sets 146 can include data associated with thresholds or other parameters of system 100, such as, operational data, maintenance data, equipment set up, equipment alarm history, prime mover information, equipment health ratings, or the like.

Application(s) 136 may communicate (e.g., send and/or receive) with processor 134 and memory 132. For example, application(s) 136 may receive data from sensor(s) or memory 132 (e.g., data sets 146), manipulate or organize the data, and send a signal to processor 134 to cause the processor to output the data (e.g., via interface 150 or I/O device 154) or store the data (e.g., via memory 132). In some configurations, application(s) 136 comprises COMSOL, ABAQUS, ImageJ, Matlab, Solidworks, AutoCAD, ANSYS, LabView, CATIA, OpenFoam, HFSS, Mathcad, combination thereof, or the like.

In the depicted configuration, control system 102 may comprise one or more interface(s) 150, one or more I/O device(s) 154, and a power source 158 coupled to controller 130. System 100 can include one or more sensor(s) configured to detect one or more parameters and to provide data to controller 130 (e.g., via control signal 148). Each component of control system 102 can be in signal communication with one or more other components of the control system, which can be a wired connection or a wireless connection. In some configurations, circuitry (e.g., a PCB, wires, etc.) may connect components of control system 102 with one or more other components of system 100. Additionally, or alternatively, components of control system 102 may be in wireless communication with one or more other components of system 100 such as, for example, via be Wi-Fi®, Bluetooth®, ZigBee, or forms of near field communications. In some configurations, components may be in signal communication via one or more intermediate controllers or relays that are in signal communication with one another. For example, a pump output pressure transducer may be in direct electrical communication with a pump controller and the pump controller may be in direct electrical communication with a controller of the mobile power unit 112*a* which is in communication with the controller 130.

Interfaces 150 may include a network interface and/or a device interface configured to be communicatively coupled to one or more other devices. For example, interfaces 150 may include a transmitter, a receiver, or a combination thereof (e.g., a transceiver), and may enable wired communication, wireless communication, or a combination thereof, such as with I/O device 154. The I/O device(s) 154 may include a touchscreen, a display device, a light emitting diode (LED), a speaker, a microphone, a camera, keyboard, computer mouse, another I/O device, or any combination thereof, as illustrative, non-limiting examples. In some configurations, interfaces(s) 150 and/or I/O device(s) 154 may enable a wired connection to controller 130 via a port or other suitable configuration.

Power source 158 may be coupled to controller 130, interface(s) 150, I/O device(s) 154, or combination thereof. In some configurations, power source 158 may be coupled to components of control system 102 via circuitry. In some configurations, power source 158 may include a battery, generator (e.g., 116), electrical grid, or the like. Although system 100 has been described as including interface(s) 150, I/O device(s) 154, and power source 158, in other configurations, the system may not include one or more of the interface(s), I/O device(s), or power source.

Controller 130 is configured to generate and send control signals 148. For example, controller 130 may generate and/or send control signals 148 responsive to receiving a signal and/or one or more user inputs via the one or more interfaces 150 and/or the one or more I/O devices 154. Additionally, or alternatively, controller 130 may generate and/or send control signals 148 responsive to one or more of instructions 142, thresholds 144, or data sets 146, or receiving a control signal from one or more components of system 100, such as, pumps 114, blender 118, generator 116, or controllers thereof, sensors, or other components.

The controller 130 may be in signal communication with the blender 118 (or controller thereof) to control the delivery of the proppant to the blender and a flow rate of fluids to or from the blender. In some configurations, the controller 130 may be in signal communication with the fracturing pumps 114 (or controller thereof) to control a discharge rate of fluid from the fracturing pumps into the manifold 108. In addition, the controller 130 may be in signal communication with one or more sensors of the wellsite hydraulic fracturing pumper system 100 to receive measurements or data with respect to the fracturing operation. For example, the controller 130 can receive a measurement of pressure of the fluid being delivered to the wellhead 110 from a wellhead pressure transducer 170, a manifold pressure transducer 172, or a pump output pressure transducer 174. The wellhead pressure transducer 170 can be disposed at the wellhead 110 to measure a pressure of the fluid at the wellhead 110. The manifold pressure transducer 172 is shown at an end of the manifold 108. However, as understood by those skilled in the art, the pressure within the manifold 108 is substantially the same throughout the entire manifold such that the manifold pressure transducer 172 may be disposed anywhere within the manifold to provide a pressure of the fluid being delivered to the wellhead 110. The pump output pressure transducer 174 can be disposed adjacent an output of one of the fracturing pumps 114 which is in fluid communication with the manifold 108 and thus, the fluid at the output of the fracturing pumps is at substantially the same pressure as the fluid in the manifold and the fluid being provided to the wellhead 110. At least some of (e.g., up to and including all of) the fracturing pumps 114 may include a pump output pressure transducer 174 and the controller 130 may calculate the fluid pressure provided to the wellhead 110 as an average of the fluid pressure measured by each of the pump output pressure transducers 174. In some configurations, controller 130 may be in signal communication with one or more other sensors such as tub level sensors, pressure sensors, magnetic pickups, power draw sensors, or the like.

In some configurations, the controller 130 may be in signal communication with sensors disposed about the blender 118. For example, the blender 118 may include a blender controller that is configured to perform one or more operations or transmit one or more signals with respect to the components of the blender or other sub-units of system 100, such as a flow meter, encoder, or pickup. For example, controller 130 can receive data, such as a rotation rate or feed rate of the proppant transport system 128 (e.g., screw conveyors, belt conveyors, or other suitable solids transport system) or other information to determine an amount of proppant delivered to blender 118, a flow rate of fluid going into or out of the blender, or the like.

In some configurations, instructions 142 (e.g., control logic) may be configured to, when executed by the one or more processors 134, cause the processor(s) to perform one or more operations. For example, the one or more operations may include receiving a message (e.g., control signal 148, a command, or an instruction) to perform an operation and identifying the requested operation. To illustrate, the operation may include controlling the flow of fluid, additives, or mixed fluid in a multi-blender system (e.g., 118). For example, one or more operations may include actuating one or more valves, such as a crossover valve, to transmit the fluid between two blending units, adjusting (e.g., reducing or stopping) a speed of a first pump of a first blending unit, and adjusting (e.g., increasing) the speed of a second pump of a second blending unit. The one or more operations may also include transmitting or receiving one or more signals 148 to one or more other components, such as one or more pumps 114 or controller thereof, generator 116 or controller thereof, mobile power units 112*a*, 112*b*, or controller thereof. In some configurations, operations can include receiving data such as pump information, operational data, maintenance data, equipment set up, equipment alarm history, prime mover information and equipment health ratings.

Referring now to FIGS. 3A-3E, shown are various views of a blender 310 (e.g., multi-blender system) which can be utilized in hydraulic fracturing operations, such as those described herein. In some configurations, blender 310 can include or correspond to blender 118 of FIG. 2A. Blender 310 is configured to mix fluid (e.g., from a hydration unit) with one or more additives (e.g., from a sand transport system, chemical additive unit, dry additive unit, or the like) and deliver the fluid to one or more other components (e.g., pumps) in the fracturing system. In the depicted configuration, blender 310 includes two separate blender units each configured to be controllable independent of one another as described herein. Each blender unit can be coupled to a power source, such as a generator, to transfer fluid between components of the hydraulic fracturing system and can be utilized for operation in single hydraulic fracturing operations and simultaneous hydraulic fracturing operations.

Figure 3A:
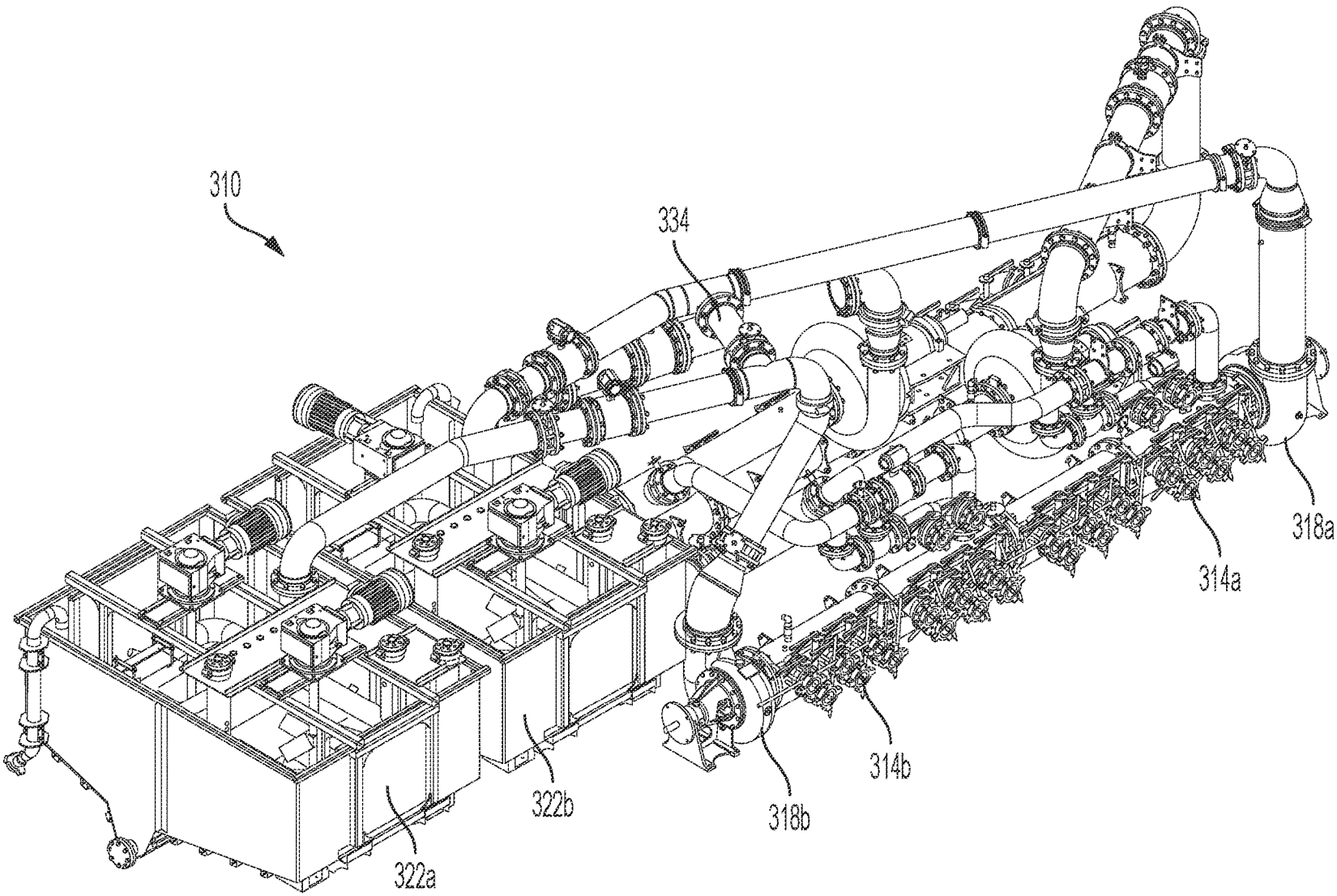
FIG. 3A shows a perspective view of a blender according to an example of the present disclosure.
Figure 3B:
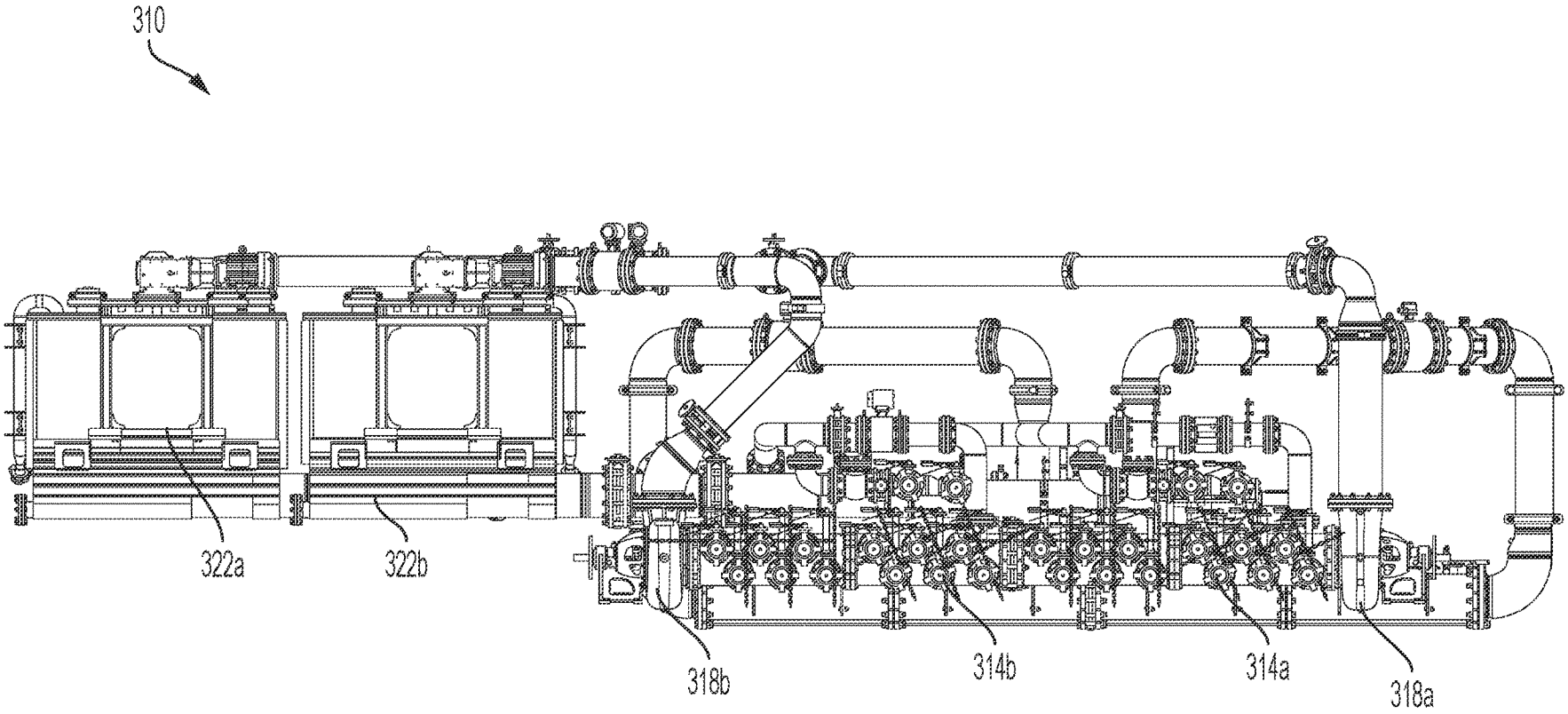
FIGS. 3B and 3C show first and second side views of the blender of FIG. 3A.
Figure 3C:
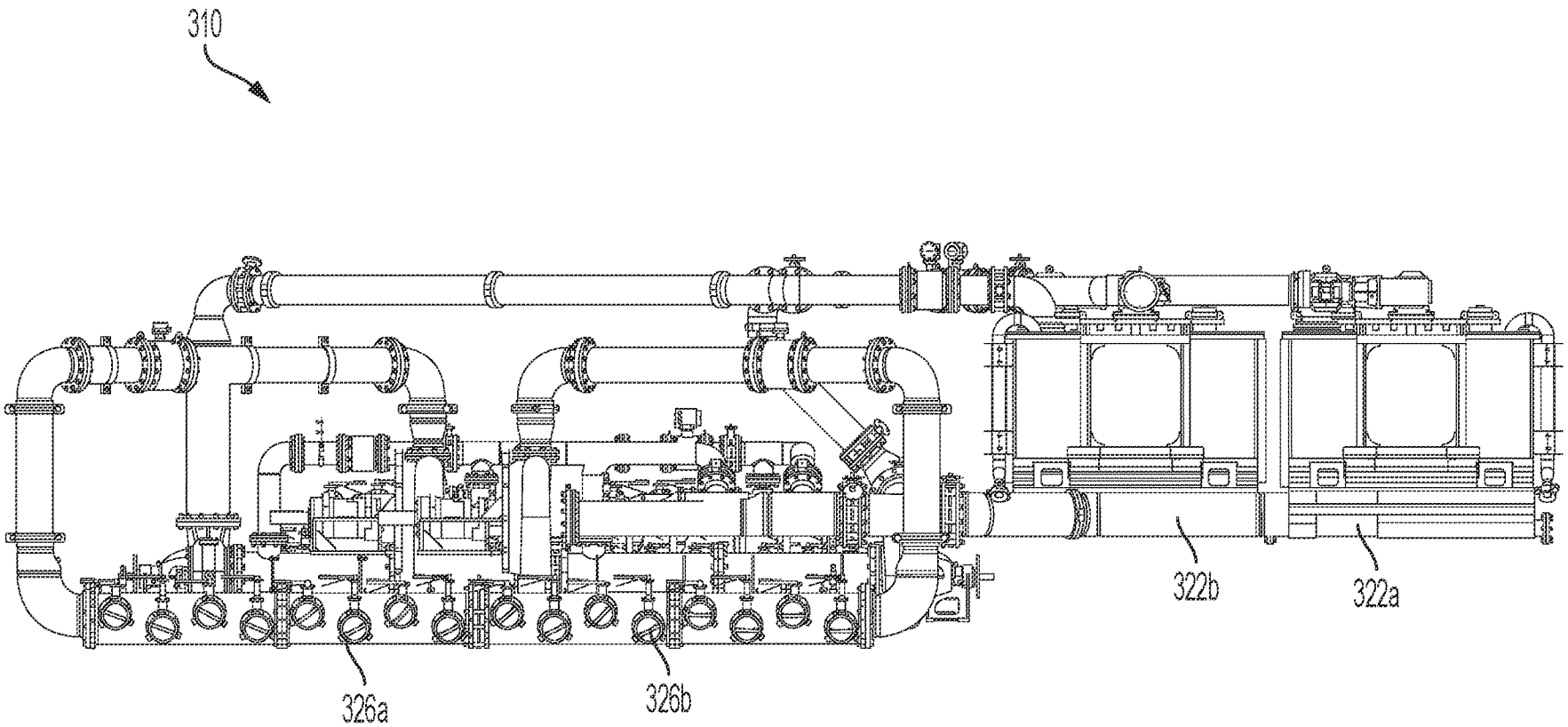
Figure 3D:
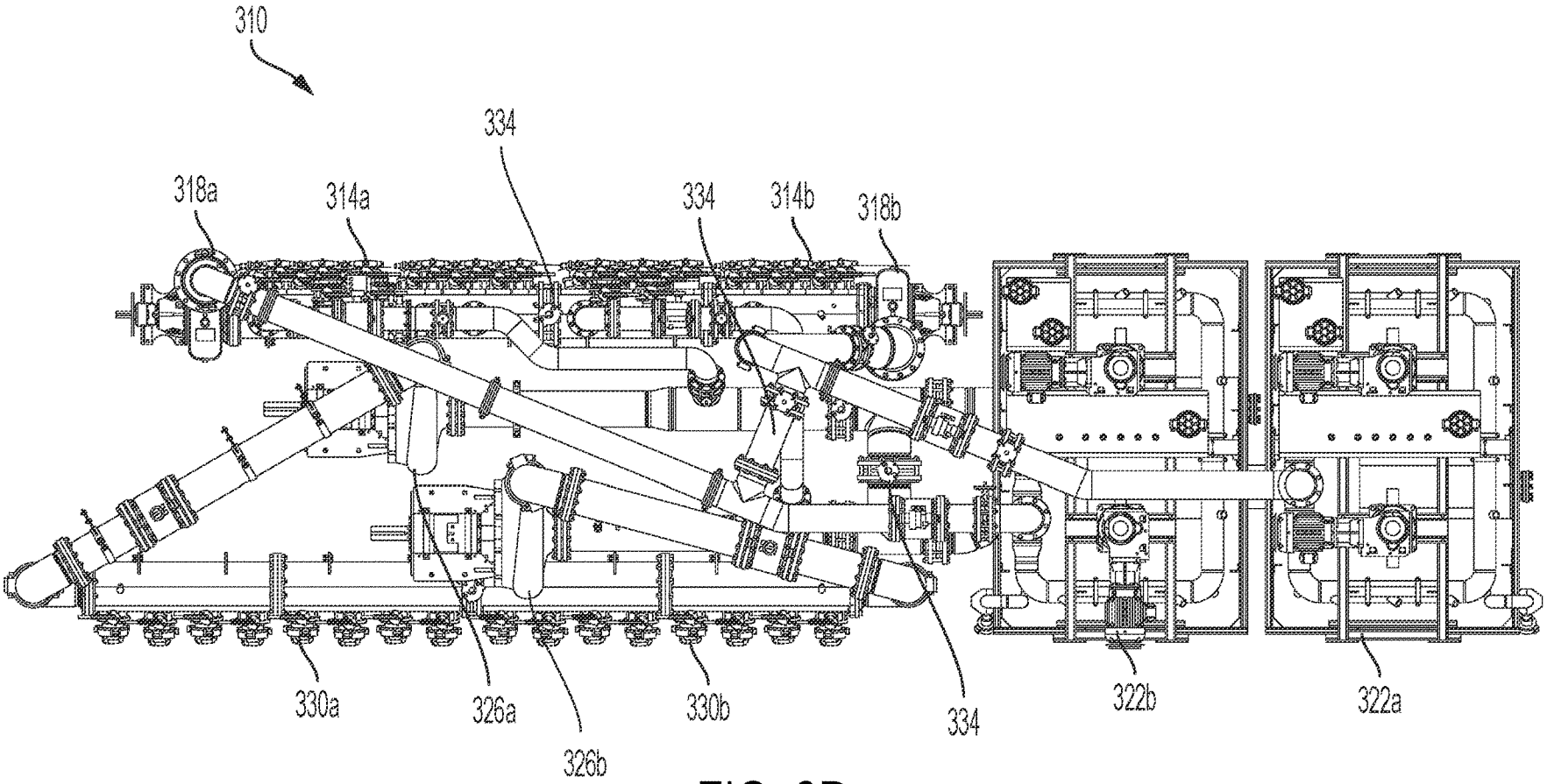
FIG. 3D shows a top view of the blender of FIG. 3A.
Figure 3E:
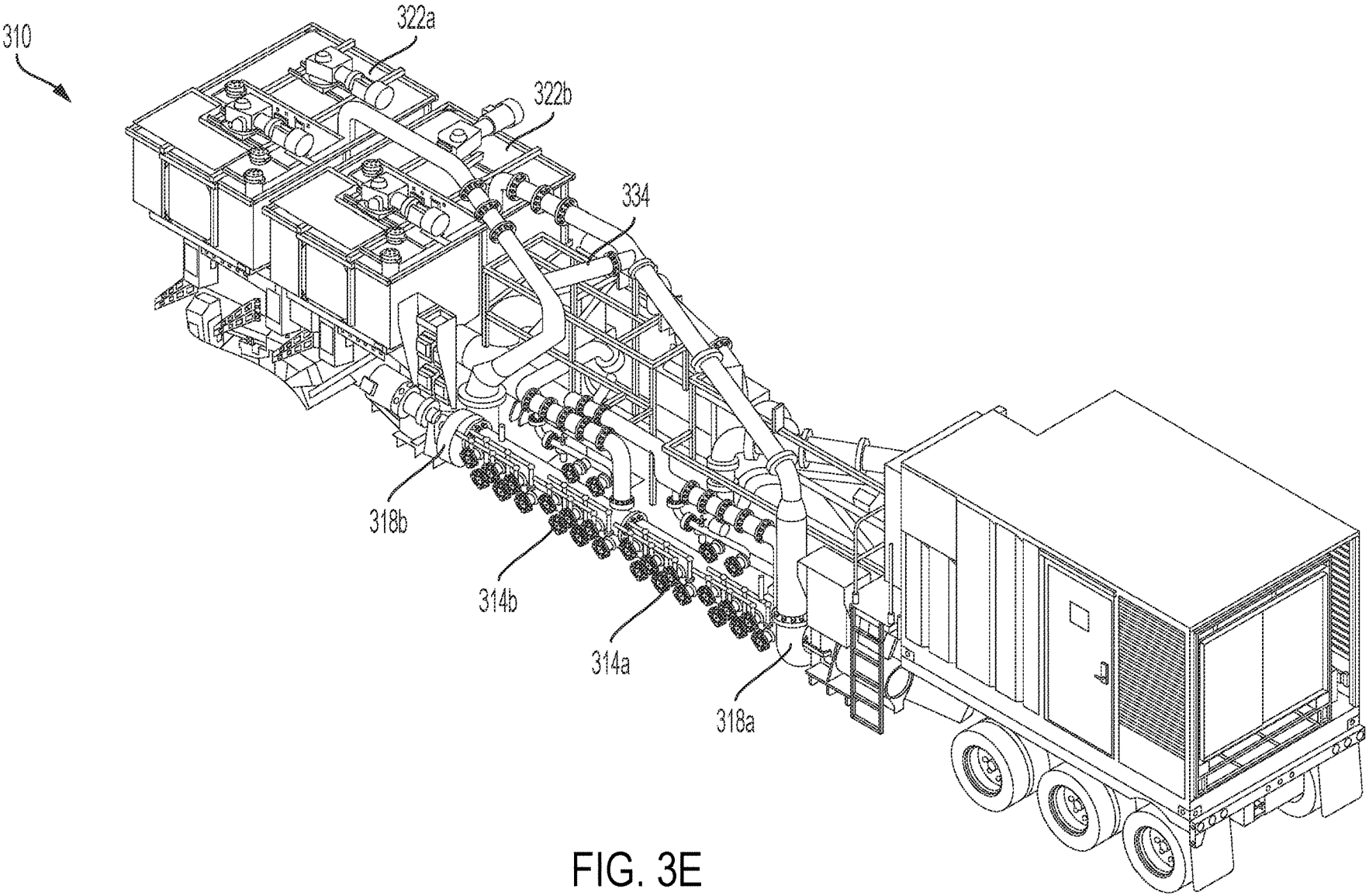
FIG. 3E shows a perspective view of the blender of FIG. 3A mounted on a trailer frame.

Blender 310 may include a first blender unit and a second blender unit positioned adjacent each other on the same trailer (e.g., as shown in FIG. 3E). First blender unit can include a first inlet manifold 314*a*, a first suction pump 318*a*, a first tub 322*a*, a first discharge pump 326*a*, and a first outlet manifold 330*a*. Additionally, or alternatively, second blender unit can include a second inlet manifold 314*b*, a second suction pump 318*b*, a second tub 322*b*, a second discharge pump 326*b*, and a second outlet manifold 330*b*.

First inlet manifold 314*a* includes a plurality of ports that are configured to be fluidly coupled to one or more fluid sources. In an illustrative configuration, ports of first inlet manifold 314*a* can be coupled to an outlet of a hydration unit (e.g., 126), water tanks (e.g., 120), or other fluid source. First inlet manifold 314*a* is configured to be in fluid communication with first suction pump 318*a* that is configured to deliver fluid from respective inlet ports to first tub 322*a* or second tub 322*b*. For example, in some configurations, first suction pump 318*a* is configured to deliver fluid exclusively to first tub 322*a* and, in other configurations, the first suction pump is configured to deliver fluid to second tub 322*b* via a crossover line 334 (e.g., via actuation of a crossover valve).

First outlet manifold 330*a* includes a plurality of ports that are configured to be fluidly coupled to one or more components to deliver mixed fluid or slurry, such as fracturing pumps (e.g., 114), a manifold (e.g., 108), the wellhead (e.g., 110), or the like. First outlet manifold 330*a* is configured to be in fluid communication with first discharge pump 326*a* that is configured to deliver fluid from first tub 322*a* or second tub 322*b* to ports of the first outlet manifold. For example, in some configurations, first discharge pump 326*a* is configured to deliver fluid exclusively from first tub 322*a* to first outlet manifold 330*a* and, in other configurations, the first discharge pump is configured to deliver fluid from second tub 322*b* to the first outlet manifold via a crossover line 334 (e.g., via actuation of a crossover valve). Each of first suction pump 318*a* and first discharge pump 326*a* can include a prime mover, such as a motor, that is configured to drive the pump and can be any suitable pump, such as a centrifugal pump.

First tub 322*a* can be configured to be in fluid communication with first inlet manifold 314*a*, first suction pump 318*a*, first discharge pump 326*a*, first outlet manifold 330*a*, second inlet manifold 314*b*, second suction pump 318*b*, second discharge pump 326*b*, or second outlet manifold 330*b* depending on the operation of blender 310. First tub 322*a* is configured to mix fluid and solid particulates and can include or be coupled to a mixer, such as a tub pump or a motor coupled to one or more paddles or other agitators. In some configurations, first tub 322*a* is configured to be in fluid communication with a first proppant transport system that is separate from the proppant transport system of second tub 322*b*. In some configurations, the mixer (e.g., mixing pump, paddle mixer, etc.) is separate from the suction and discharge pumps (e.g., 318, 326) and can be configured to only to mix the fluid (e.g., slurry) and not pressurize or discharge the fluid. In such configurations, the rate of agitation in first tub 322*a* may be independent of a rate of discharge of fluid from the tub. This is contrary to the traditional mixing systems that integrate the mixing tub and the pump to save space and provide more compact blender. In the depicted configurations, by including crossover line 334 between the tubs (e.g., 316) and the discharge pumps (e.g., 326) each pump can be configured to draw fluid from either mixing tub. Such configurations allow near instantaneous switching between mixing tubs and, in split streaming process, enable near instantaneous switching between a fluid-only tank and a slurry tank (e.g., to change slurry density or flush the well) without sacrificing pressure, flow rate, or other performance parameters. The components of second blender unit (e.g., 318*b*, 322*b*, 326*b*, 330*b*) can be configured similarly to the components of the first blender unit described above.

One or more crossover lines 334 are disposed between components of the first and second blender units. For example, a crossover line can be disposed between the first and second tubs 322*a*, 322*b* and first and second discharge pumps 326*a*, 326*b*. In some configurations, a crossover line 334 can be posited between first inlet manifold 314*a* and second inlet manifold 314*b*, between first outlet manifold 330*a* and second outlet manifold 330*b*, or both. Additionally, or alternatively, a crossover line 334 can be disposed between the first and second tubs 322*a*, 322*b* and first and second suction pumps 318*a*, 318*b*. In this way and others, the components of the first and second blender units can be operated both independently and interchangeably as described in further detail in U.S. application Ser. No. 17/807,658 filed on Jun. 17, 2022, which is hereby incorporated by reference in its entirety.

Each blender unit can be operated via the control systems (e.g., 102) described herein and can be configured to provide redundancy in the event one of the blender units fails or to use different fluid mixtures (or concentrations thereof) for different pumps, such as during split streaming operations. The control system can actuate one or more valves, pumps, or motors, to control the flow of fluid and additives within blender 310. For example, control system can operate each of first and second blending unit independently during normal operations. To further illustrate, the first blending unit can be configured to provide different sand concentrations, a different amount of fluid volumes, different chemical loadings, different treatment schedules, as compared to the second blending unit. In some configurations, such as during failure of one of the blending units, the control system can be configured to operate the remaining blending unit while the unactive blending unit is repaired or replaced. In configurations in which the blending units are operating for different well sites (e.g., in simultaneous fracturing operations), a single blending unit can be utilized to temporarily supply the required fluid mixture to both well sites until operations can be stopped or the other blending unit can be repaired.

Figure 4:
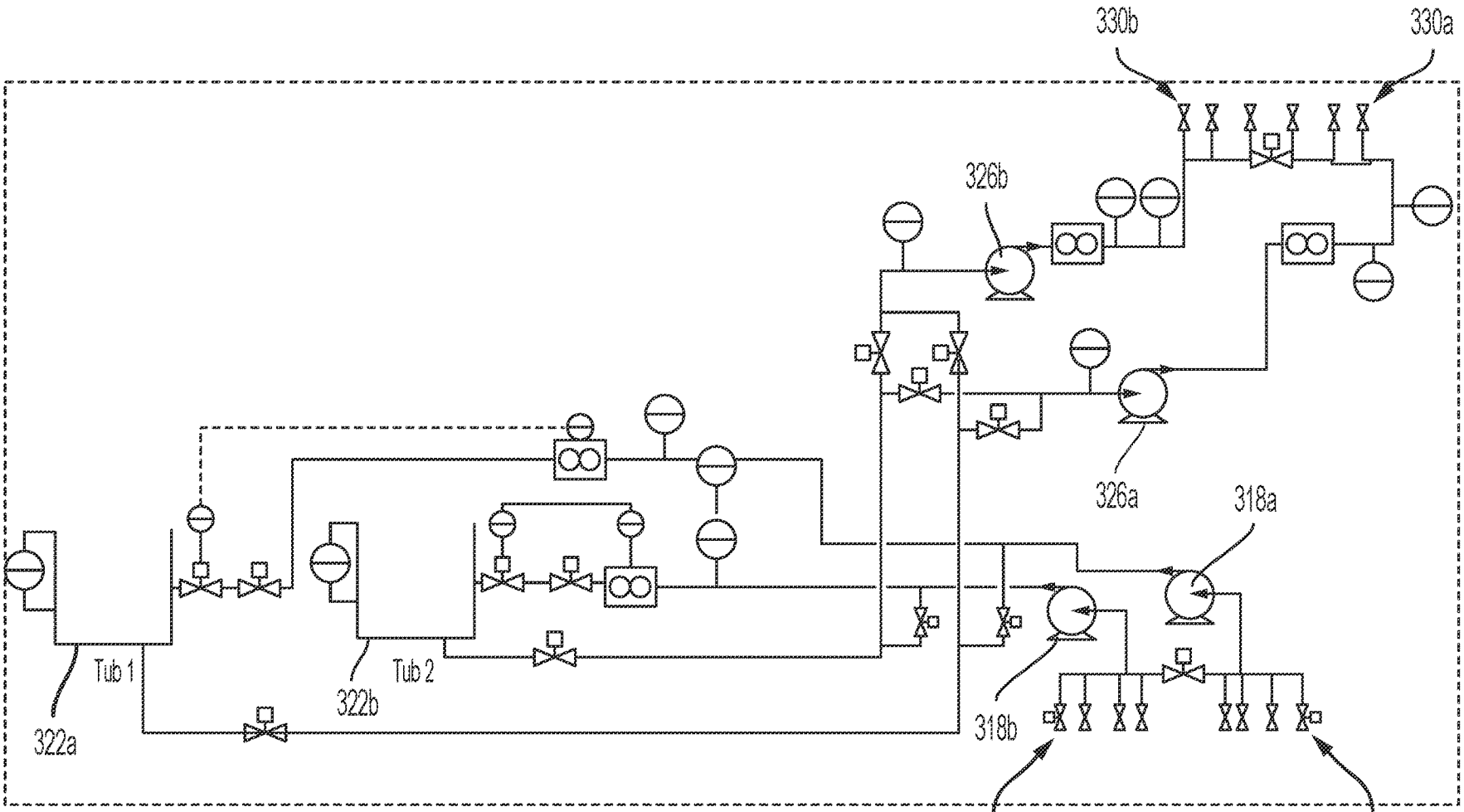
FIG. 4 shows a schematic operational diagram of the blender of FIG. 3A.

To further illustrate the operation of blender 310, FIG. 4 depicts a schematic operation diagram of the blender. As described herein, blender 310 can define a plurality of different flow paths between each of the components of the first and second blending units and control system can adjust the flow path based on data or other operations described herein. In some such operations, it possible to run two different sand concentrations on the same blender at any given time. For example, while a first blender is running a certain concentration of sand, a second blender could be run without sand, such as a water mixed with a chemical. In some hydraulic fracturing operations, a group of pumps at a wellsite will pump sand on a first side (e.g., the dirty side) and a group of pumps will only pump fresh water on a second side (e.g., the clean side), also known as split streaming. Each blender of the multi-blender system (e.g., 410) described herein can operate as both clean and dirty sides and can be configured to maintain split stream operations in the event of a failure of one of the blenders and maintain operation integrity in the event of a component failure.

As shown in FIG. 4, blender 310 can include a plurality of valves that can be actuated by control system to direct the flow path of fluid between the inlet manifolds (e.g., 314), suctions pumps (e.g., 318), tubs (e.g., 322), discharge pumps (e.g., 326), and outlet manifolds (e.g., 330). As depicted, blender 310 can be able to operate multiple blending units independently while also providing redundancy to operate each blending unit. For example, fluid can be drawn from first inlet manifold 314*a*, to first suction pump 318*a* or to second suction pump 318*b* via a first crossover line. In some configurations, fluid can be drawn from second inlet manifold 314*b* to second suction pump 318*b* or to first suction pump 318*a* via the first crossover line. Fluid from first suction pump 318*a* can then transferred to an inlet of first tub 322*a* or to an inlet of second tub 322*b* via a second crossover line. For example, the piping between first suction pump 318*a* can extend to both first tub 322*a* and second tub 322*b* and the flow path can be controlled via actuation of valves. In some configurations, fluid from second suction pump 318*b* can be transferred to an inlet of second tub 322*b* or to an inlet of first tub 322*a* via the second crossover line. Fluid from first tub 322*a* can be drawn to first discharge pump 326*a* or second discharge pump 326*b* via a third crossover line and fluid from second tub 322*b* can be drawn to the second discharge pump or the first discharge pump via the third crossover line. Fluid from first discharge pump 326*a* can then be transferred to first outlet manifold 330*a* or second outlet manifold 330*b* via a fourth crossover line or fluid from second discharge pump can be transferred to the second outlet manifold or the first outlet manifold via the fourth crossover line.

Figure 5A:
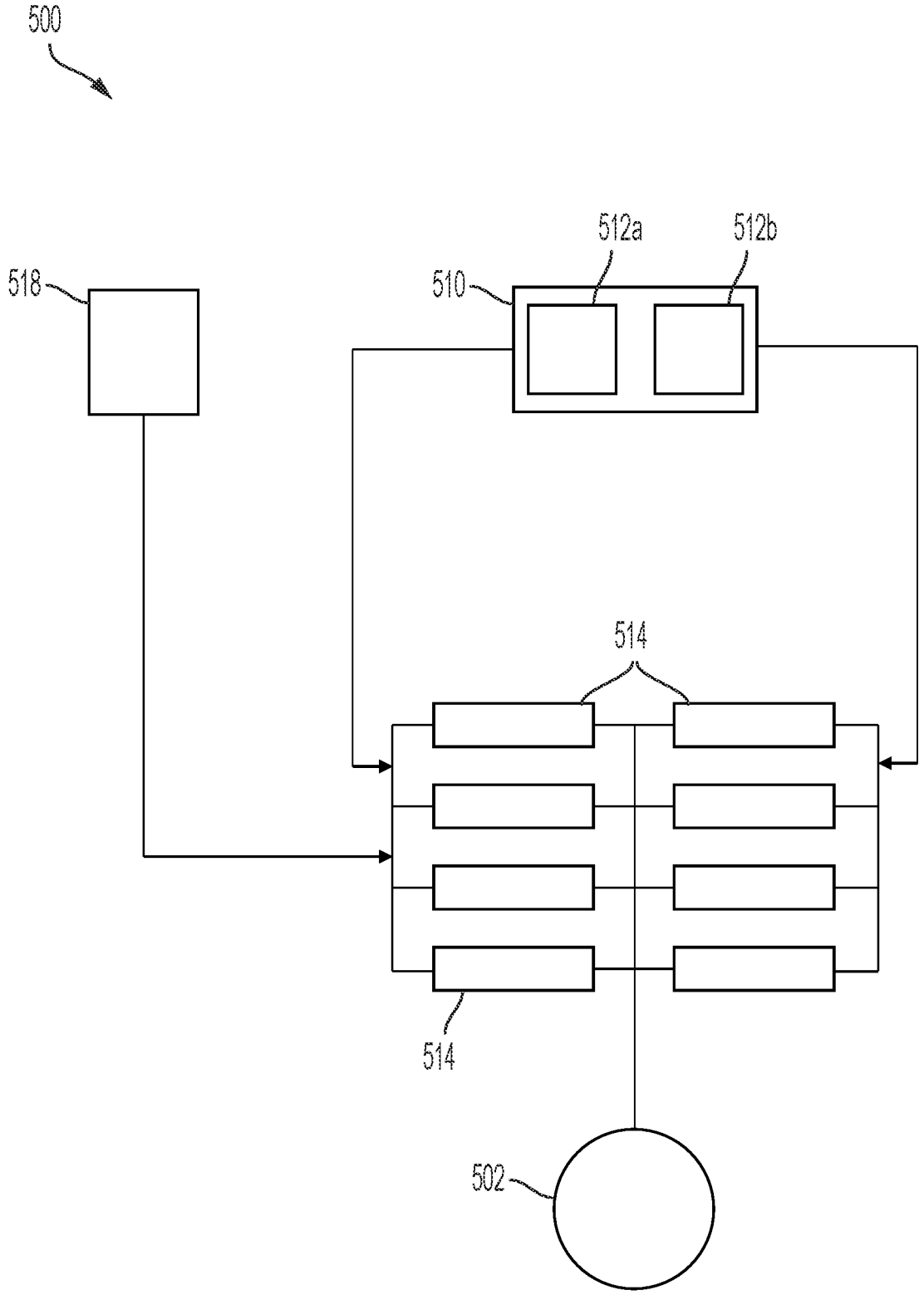
FIG. 5A shows a schematic view of a wellsite hydraulic fracturing system according to one example of the present disclosure.

Referring now to FIG. 5A is an example of a hydraulic fracturing pumper system 500 for delivering fluid into a wellbore 502. System 500 includes a multi-blender system 510 that is configured to deliver a fluid (e.g., water or slurry) to a fleet of pumpers 514 that are configured to inject the fluid into wellbore 502. Blender 510 includes a first blender unit 512*a* and a second blender unit 512*b* configured to operate independently of one another, as described herein. Each of first and second blender units 512*a*, 512*b* can be disposed on the same platform (e.g., trailer, truck, or other platform). In some configurations, system 500 can include one or more additional pumps 518 configured to deliver a fluid to pumpers 514. For example, pump 518 may be coupled to a clean fluid source (e.g., 120) and is configured to deliver non-abrasive fluid to pumpers 514. In some configurations, pump 518 can include one or more centrifugal pumps, however, other suitable pumps can be employed. Pump 518 can be connected directly to one or more pumpers or can be connected to a fluid line downstream of the blender units (e.g., 512*a*, 512*b*) to change the fluid properties after discharge from the blender units (e.g., to control the sand concentration or fluid density downstream of the blender). Although not shown for the sake of clarity, system 500 can include one or more additional components, such as the components shown in system 100. In some configurations, system 500 can include or correspond to system 100, such as, for example, blender 510 can include or correspond to blender 118 or blender 310 and pumpers 514 can include or correspond to power units 112*a* and pumps 114.

As depicted, system 500 includes eight pumpers 514 configured to deliver fluid to wellbore 502 at flowrates and pressures sufficient to perform hydraulic fracturing as understood in the art; however, it should be understood that any other suitable number of pumpers can be used to perform the operations described herein. The pumpers 514 can be configured or operated to receive a clean fluid (non-abrasive fluid that is substantially free of solid particulates—e.g., less than 5, 4, 3, 2, or 1% of solids by volume) or a dirty fluid (abrasive fluid—such as fluid mixed with proppant). Each pumper 514 can be configured to receive a fluid from one of first blender unit 512*a*, second blender unit 512*b*, pump 518, or combination thereof. In some configurations, at least one pumper 514 (up to and including all pumpers) is coupled to at least two of: first blender unit 512*a*, second blender unit 512*b*, or pump 518. In such configurations, pumper 514 can include or be coupled to one or more valves that may be actuated to selectively switch between receiving fluid from the first blender unit 512*a*, second blender unit 512*b*, or pump 518. To illustrate, a pumper (e.g., 514) can be coupled to first blender unit 512*a* and pump 518 and system 500 can be controlled such that the pumper can receive fluid from either first blender unit 512*a* or pump 518. Some configurations may be further be able to selectively receive two fluid sources simultaneously, such as from both the first blender unit and the pump. In this way and others, a fluid source of pumpers 514 can be more actively controlled as compared to traditional systems. Additionally, or alternatively, the sand concentration of blender 510 can be quickly increased by actuating one or more valves on the blender or in the coupling to pumpers 514. This makes it possible to quickly control the proppant concentration as compared to the conventional method, in which it is necessary to switch out the tub or wait for the sand concentration in the tub to change.

Figure 5B:
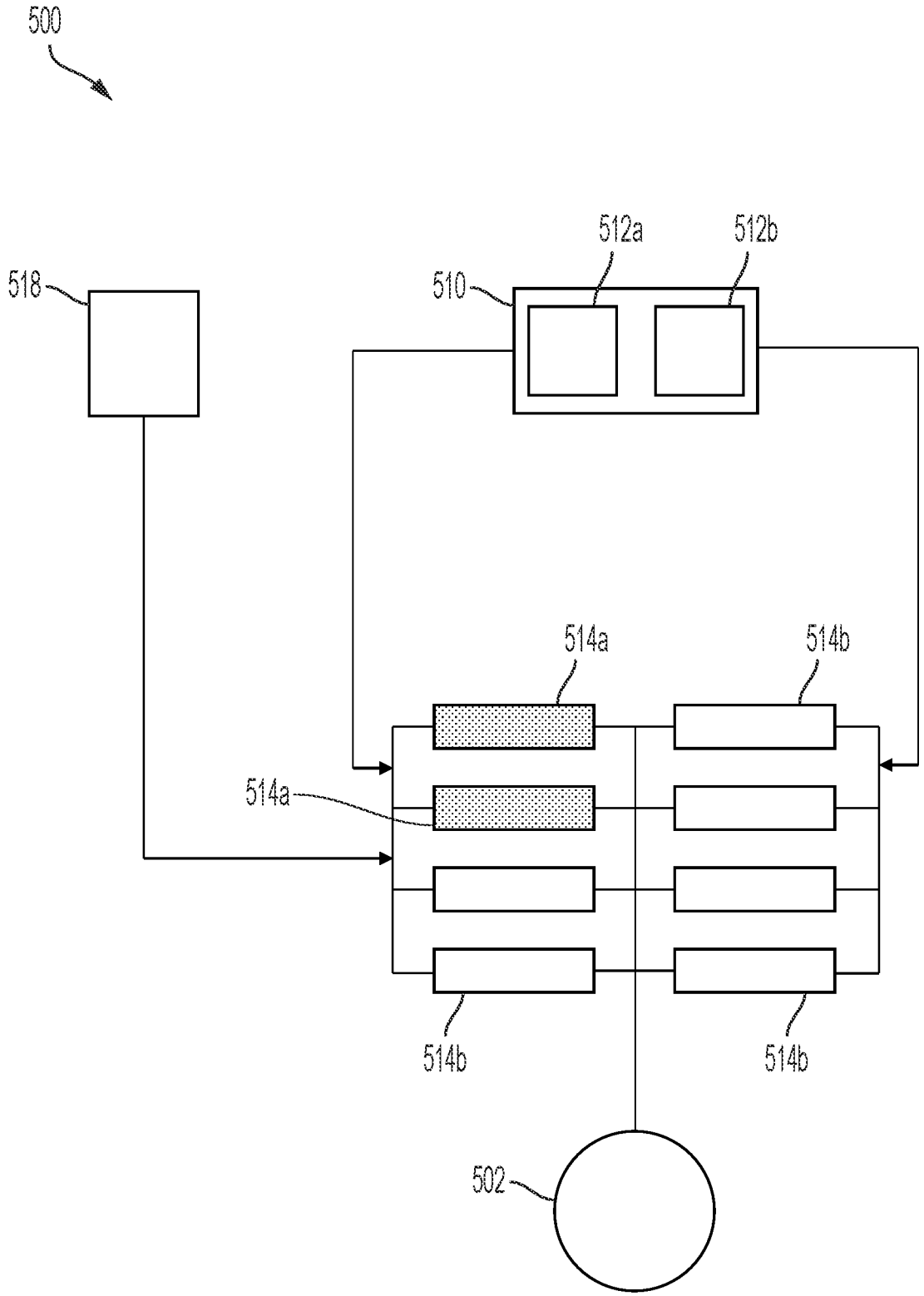
FIG. 5B shows the hydraulic fracturing system of FIG. 5A in a split stream operation.

Referring now to FIG. 5B, system 500 is depicted during a split stream operation. In the split stream operation, a group of pumpers 514*a* will pump dirty fluid on a first side (e.g., the dirty side) and a group of pumpers 514*b* will pump clean fluid on a second side (e.g., the clean side). Although FIG. 5B shows the system 500 as having two dirty pumpers 514*a* and six clean pumpers 514*b*, in alternative configurations the system may contain any appropriate number of dirty pumps and clean pumps, dependent on the hydraulic horsepower required by the well, the amount of proppant desired to be pumped, the required flow rate or pressure of the fluid to be delivered to the well, or other considerations. Clean pumpers 514*b* may have a much longer useful life as the pumps are not subject to abrasive media and will accumulate much less wear and other damage. Although dirty pumps (e.g., 514*a*) may be exposed to a greater concentration of abrasive media to obtain the same amount of proppant to be delivered to wellbore 502, the increased wear on the dirty pumps is outweighed by the extended life of the clean pumps as explained in U.S. application Ser. No. 11/754,776.

System 500 can provide improved operational control and further extend component life in split stream operation. Each blender unit 512*a*, 512*b* of the multi-blender system 510 can operate as both clean and dirty sides and can be configured to maintain slipstream operations even during the event of a failure of one of the blender units. In a non-limited illustrative configuration, dirty pumpers 514*a* can be connected to first blender unit 512*a* to receive a slurry from the first blender unit. In some such configurations, the remaining clean pumpers 514*b* can be connected to second blender unit 512*b* or pump 518 to receive a clean fluid such that only one set of blending components from first blender unit 512*a* may handle dirty fluid. The blender unit 512*a*, 512*b* which handles dirty fluid can be selected based on suitable maintenance criteria to improve the useable life of blender 510 while also providing redundancy in case of failure of components from the blender or pumpers 514. For example, in a configuration in which first blender unit 512*a* fails, second blender unit 512*b* can be operated to begin delivering dirty fluid to pumpers 514 and pump 518 can be operated to compensate for any decrease in clean fluid delivery from the switch in operation of the second blender unit. In another example in which a dirty pumper 514*a* fails, first blender unit 512*a* can be operated to begin delivering dirty fluid to a pumper (e.g., 514) that was previously being operated as a clean pumper to compensate for the reduction in slurry from the failed dirty pumper. In an alternate configuration, second blender unit 512*b* can be operated to begin delivering dirty fluid to clean pumpers (e.g., 514*b*) based on a failure of one or more dirty pumper 514*a*. In yet another configuration, pump 518 may reduce its output to a pumper (e.g., 514) that is also receiving dirty fluid from first blender unit 512*a* so that a sand concentration of the fluid received by the pumper is increased. The configurations described above are not intended to be limited but are intended to show the improved operational control provided by system 500 compared to traditional blending systems.

Figure 6A:
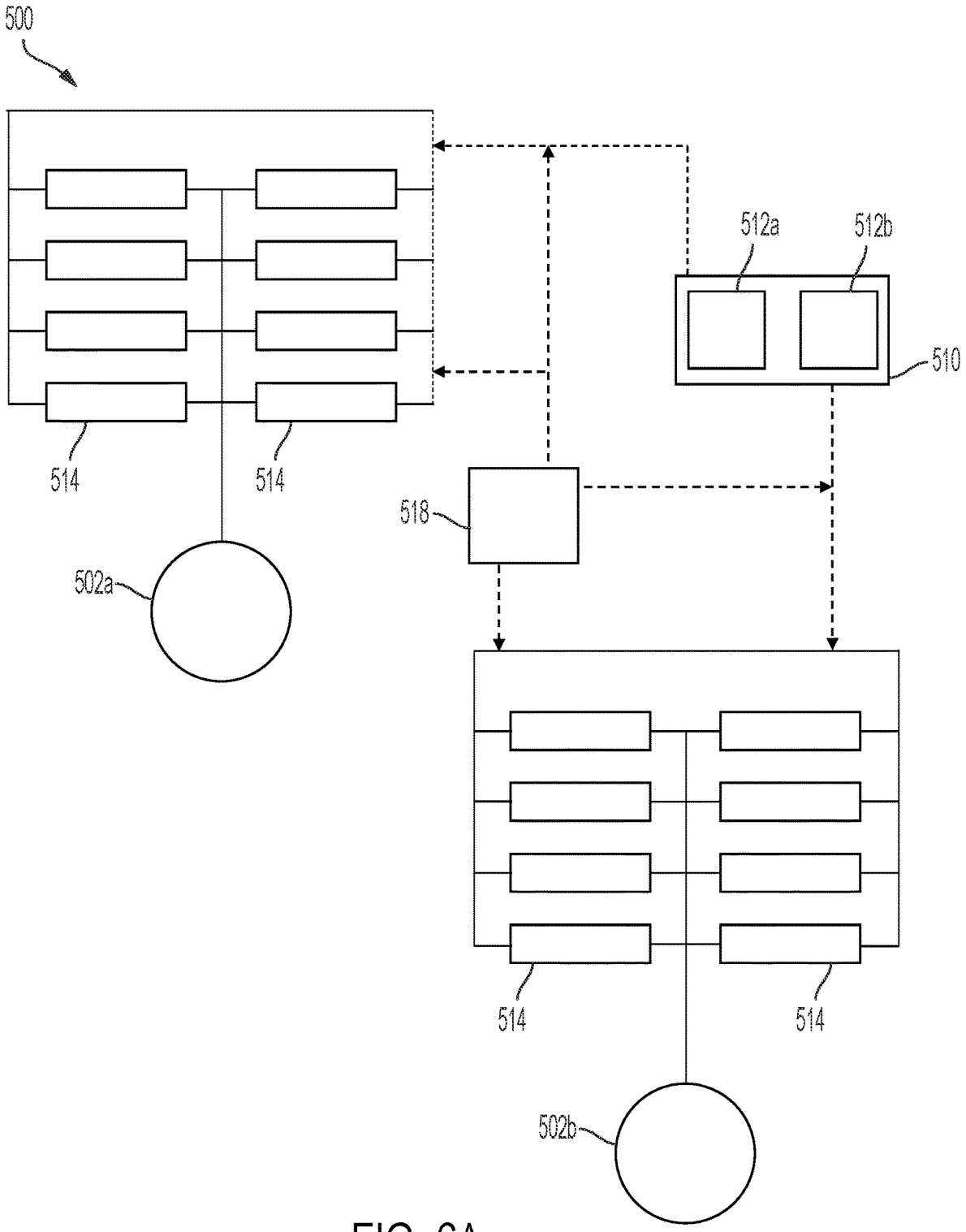
FIG. 6A shows a schematic view of a wellsite hydraulic fracturing system according to another example of the present disclosure.

Referring now to FIG. 6A is an example of a hydraulic fracturing pumper system 500 during simultaneous fracturing operations, which allows for fracturing of two wells 502*a*, 502*b* in parallel. In such an operation, blender 510 and pump 518 may be connected to a first fleet of pumpers 514 for fracturing a first well 502*a* and to a second fleet of pumpers 514 for fracturing a second well 502*b*. In some configurations, first blender unit 512*a* and pump 518 can be connected to the first fleet of pumpers 514 and second blender unit 512*b* and pump 518 can be connected to the second fleet of pumpers 514. Although pump 518 is described as a single pump, it should be understood that pump 518 can include multiple separate pumps (e.g., one or more first pumps connected to the first fleet of pumpers and one or more second pumps connected to the second fleet of pumpers). As each of first and second blender units 512*a*, 512*b* are operable independently of one another, as described above, blender 510 can operate on two different wells 502*a*, 502*b* even if they require different operational properties. This makes it possible to independently control both fracturing fleets so that the two wells 502*a*, 502*b* can have independent fracturing conditions, such as different sand concentrations, a different amount of fluid volumes, different chemical loadings, different treatment schedules, or the like.

In some configurations, the system 500 can utilize first and second blender units 512*a*, 512*b* to provide dual redundancy for both fracturing fleets in the simultaneous fracturing operation. To illustrate, in the event of a mechanical or electrical failure on one of the blender components (e.g., 512*a*), the control system (e.g., 130) can automatically adjust for the remaining active blender (e.g., 512*b*) to feed fluid to pumpers 514 of both fracturing fleets. The blender control system can automatically redirect flow to the other fleet using cross over valves (e.g., 334), for example, to feed both fleets fracturing fluid. In some configurations, the control system can slow down the hydraulic fracturing pumps (e.g., pump rate) to one or both independent fleets to maintain job reliability without cavitating the pumps. In this way, and others, the control system can continue the job operation after failure of a blender unit (e.g., 512*a*) or component thereof (e.g., at the reduced rate) to finish the stage or to flush both wells.

Figure 6B:
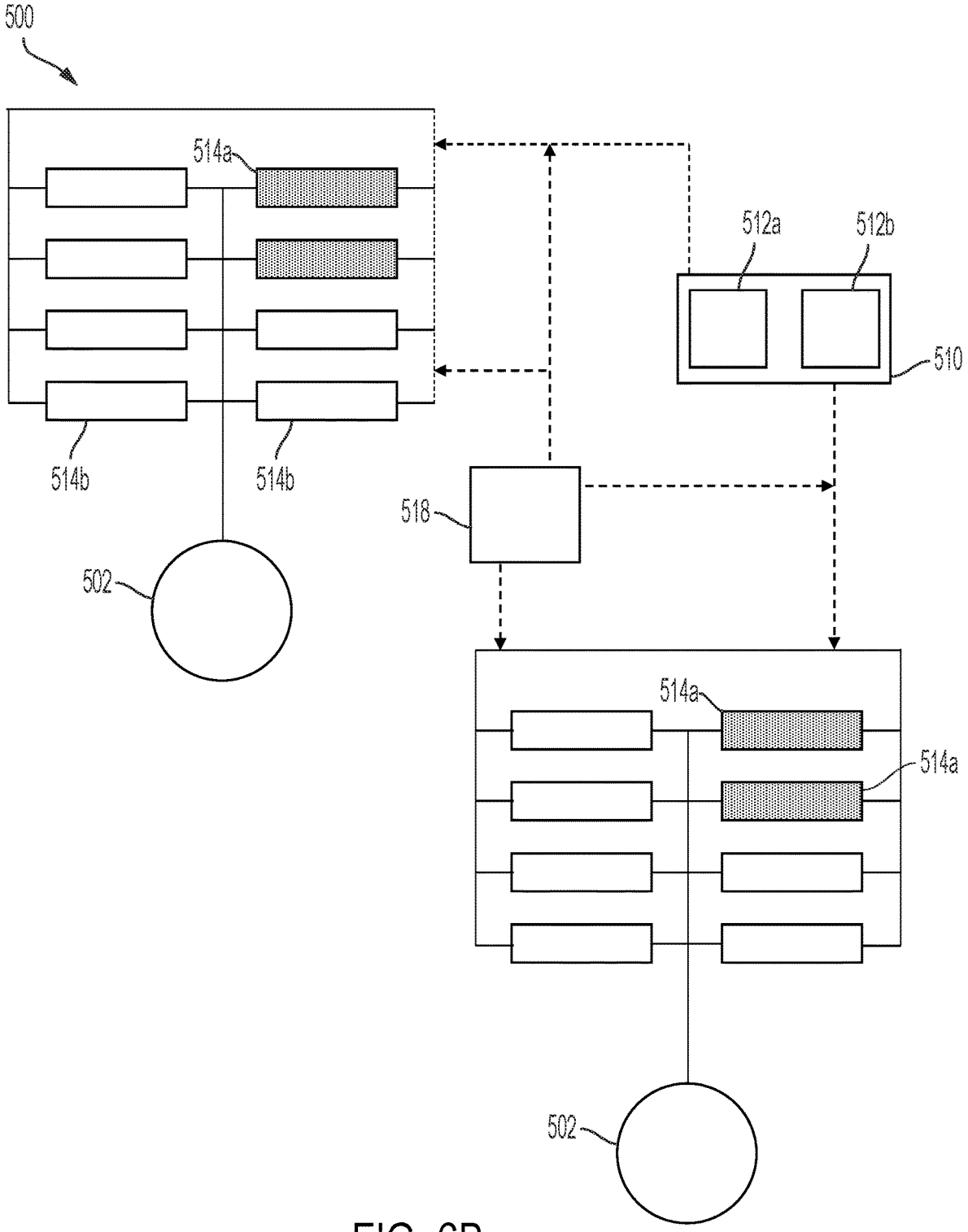
FIG. 6B shows the hydraulic fracturing system of FIG. 6A in a split stream operation.

Referring now to FIG. 6B, system 500 is depicted during a simultaneous split stream operation. In some such operations, each blender unit 512*a*, 512*b* of the multi-blender system 510 can operate to provide dirty fluid to one or more dirty pumpers 514*a* of a separate fleet of pumpers at different wellbores (e.g., 502*a*, 502*b*). For example, first blender unit 512*a* can provide dirty fluid to pumpers 514*a* of a first fleet of pumps at first well 502*a* and second blender unit 512*b* can provide dirty fluid to pumpers 514*a* of a second fleet of pumps at second well 502*b*. In such configurations, pump 518 can provide clan fluid to pumpers 514*b* at both first well 502*a* and second well 502*b*. In addition to enabling simultaneous split stream operation with a single blender, blender 510 can be configured to maintain slipstream operations even during the event of a failure of one or more components. For example, based on failure of first blender unit 512*a* (or component thereof), second blender unit 512*b* can be operated to deliver dirty fluid to both fleets of pumps at first and second well 502*a*, 502*b*. In another example, in the event of failure of one of dirty pumpers 514*a* at first well 502*a*, first blender unit 512*a* can be operated to begin delivering dirty fluid to a pumper (e.g., 514*b*) that was previously being operated as a clean pumper. In such an example, the sand concentration of first blender unit 512*a*, flow rates of first blender unit 512*a* or pump 518, or the like, can be adjusted to maintain a sand ratio at first well 502*a* without changing operations of second blender unit 512*b* or the fleet of pumpers (e.g., 514) at second well 502*b*.

Figure 7:
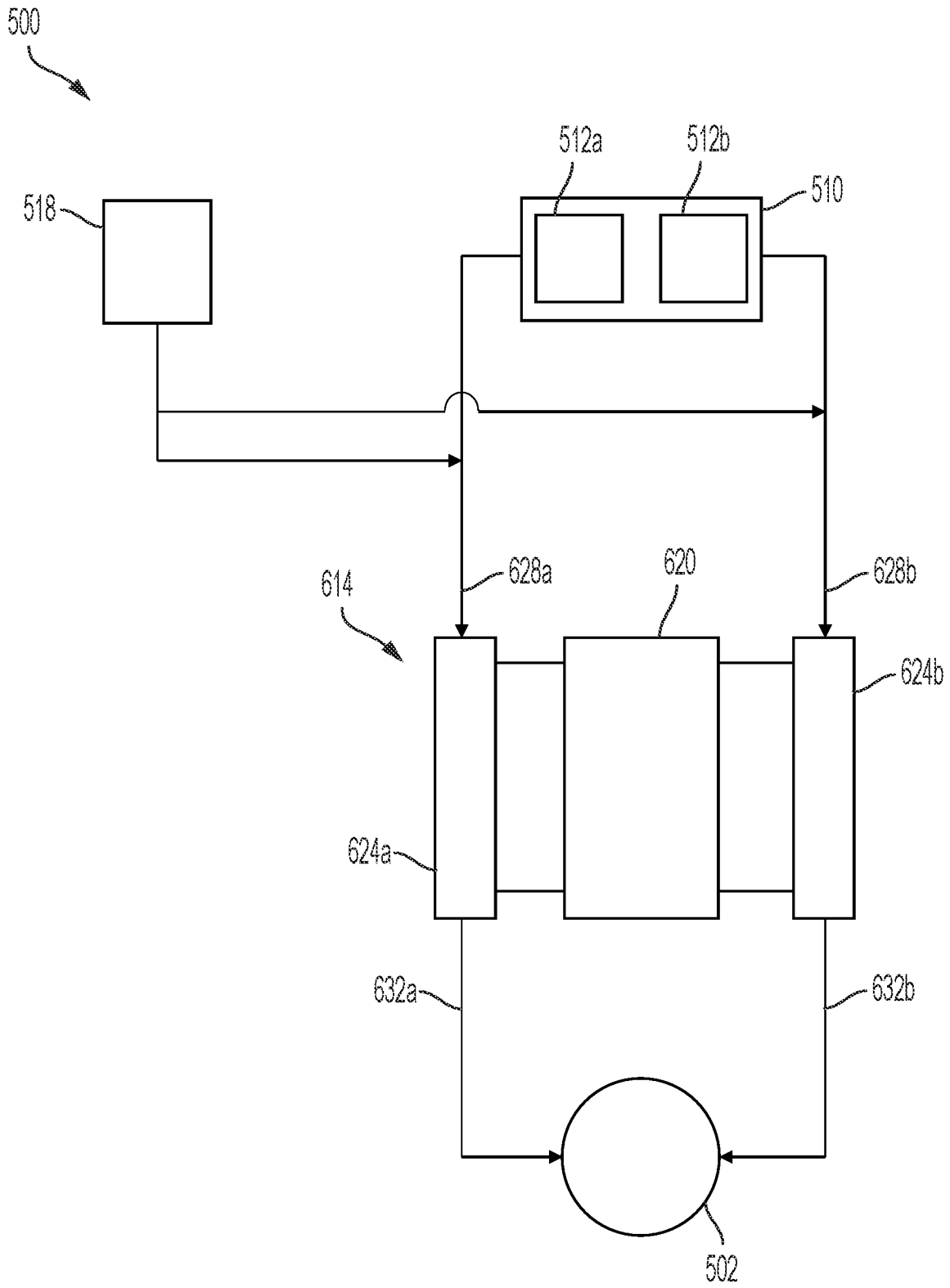
FIG. 7 shows a schematic view of a wellsite hydraulic fracturing system according to yet another example of the present disclosure.

Referring now to FIG. 7, an example of hydraulic fracturing pumper system 500 is shown in operation with a pumper 614 having a single power end 620 coupled to respective first and second fluid ends 624*a* and 624*b*. In some configurations, pumper 614 may include or correspond to pumpers 514. The first fluid end 624*a* and second fluid end 624*b* may each be connected to opposite lateral sides of power end 620 and include (or be associated with) a respective set of plungers to pressurize and discharge fluid from the respective fluid ends. Pumper 614 can be configured to pump fracturing fluids from two independent fracturing fluid supplies. For example, first fluid end 624*a* (and a first set of plungers) may be supplied by a first input conduit 628*a* for supplying a first fracturing fluid from a first fracturing fluid supply, and a first output conduit 632*a* for outputting the first fracturing fluid at high pressure and/or a high flow rate. Second fluid end 624*b* (and a second set of plungers) may be supplied by a second input conduit 628*b* for supplying a second fracturing fluid from a second fracturing fluid supply, and a second output conduit 632*b* for outputting the second fracturing fluid at high pressure and/or a high flow rate. Further details regarding pumper 614 are disclosed in U.S. application Ser. No. 17/664,578, filed on May 23, 2022, and U.S. Provisional Application No. 63/386,289, filed on Dec. 6, 2022, each of which are hereby incorporated by reference in their entirety.

In some configurations, first blender unit 512*a* can be connected to first fluid end 624*a* and second blender unit 512*b* can be connected to second fluid end 624*b*. In this way, and others, each fluid end 624*a*, 624*b* can be configured to pump different fluids into wellbore 502, similar to the other configurations of system 500 described above. As a non-limiting example, first blender unit 512*a* may supply a dirty fluid to first fluid end 624*a* and second blender unit 512*b* can supply a clean fluid to second fluid end 624*b* to enable a split steam operation for a single pumper (e.g., 614). Although FIG. 7 depicts only a single pumper 614 for clarity, it should be understood that a fleet of pumpers (e.g., 614) may be utilized for a fracturing operation. By connecting first blender unit 512*a*, second blender unit 512*b*, pump 518, or combination thereof to each fluid end 624*a*, 624*b* can operate as both clean and dirty sides of pumper 614. Such configurations can provide improved operational control at the individual pump level as well as for the fleet of pumpers, as described above. For example, in the event of a failure of a dirty pumper (e.g., 514*a*) in a split stream operation, an operator can elect to have only one fluid end (e.g., 624*a*) of a clean pumper (e.g., 514*b*) switch to pumping dirty fluid so that the useful life of the other fluid end (e.g., 624*b*) is not degraded or that maintenance only need to be performed on the one fluid end.

In some configurations, the pumper 614 can have a first set of plungers for use with the first fluid end 624*a* having a first stroke length and a second set of plungers for use with the second fluid end 624*b* having a second stroke length. In some configurations, the first stroke length can be different from the second stroke length. For example, the first stroke length can be from about 4 inches or about 6 inches to about 8 inches or about 10 inches and the second stroke length can be from about 5 inches or about 7 inches to about 9 inches or about 11 inches or more. The longer stroke lengths associated with the second set of plungers, for example, can result in larger volumetric flow rates of fluid flowing through the second fluid end during operation of the pumper 614. Such configurations can be utilized by an operator or user to plan or adjust a first rate of flow from the first fluid end 624*a* and a second rate of flow from the second fluid end 624*b*. In this way, and others, each fluid end 624*a*, 624*b* can be configured to pump different fluids into wellbore 502, similar to the other configurations of system 500 described above, under different flow rates. As described herein, the first blender unit 512*a* can supply a dirty fluid to the first fluid end 624*a* and the second blender unit 512*b* can supply a clean fluid to second fluid end 624*b* to enable a split steam operation for a single pumper (e.g., 614). By adjusting the stroke lengths associated with each fluid end 624*a*, 624*b*, an operator or user can adjust the relative flow rates of fluid flowing through the clean and dirty sides of pumper 614. Such configurations can provide improved operational control at the individual pump level as well as for the fleet of pumpers, as described above.

Although only a few illustrative configurations have been described in detail herein, those skilled in the art will readily appreciate that many modifications are possible in the exemplary configurations without materially departing from the novel teachings and advantages of the configurations of the present disclosure. Accordingly, all such modifications are intended to be included within the scope of the configurations of the present disclosure as defined in the following claims.

References are made to block diagrams of systems, methods, and apparatuses, according to example configurations. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including hand-held devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks can be performed by remote processing devices linked through a communications network.

The invention claimed is:

1. A hydraulic fracturing system, comprising:

a blender having:

a first blender unit configured to be in communication with a fleet of pumpers, the first blending unit having:

a first tub having a first mixer configured to mix fluid and solid particulates;

a first suction pump configured to deliver fluid to the first tub;

a first discharge pump configured to draw a first fluid from the first tub and deliver the first fluid to the fleet of pumpers;

a second blender unit configured to be in communication with the fleet of pumpers, the second blending unit having:

a second tub having a second mixer configured to mix fluid and solid particulates;

a second suction pump configured to deliver fluid to the second tub;

a second discharge pump configured to draw a second fluid from the second tub and deliver the second fluid to the fleet of pumpers; and a pump configured to deliver a third fluid to the fleet of pumpers, wherein at least one pumper of the fleet of pumpers is configured to be in fluid communication with at least two of: the first blender unit, the second blender unit, or the pump.

2. The system of claim 1, further comprising a plurality of crossover lines configured to provide selective fluid communication between the first blender unit and the second blender unit such that the second discharge pump is configured to draw the second fluid from the second tub and the first discharge pump is configured to draw the first fluid from the first tub.

3. The system of claim 1, wherein the first blender unit and the second blender unit are disposed on a first trailer.

4. The system of claim 1, wherein the first fluid from the first blender unit and the third fluid from the pump are configured to be mixed prior to being received at the at least one pumper.

5. The system of claim 1, further comprising:

a controller configured to be in communication with the first blender unit, the second blender unit, and the pump; and wherein the controller is configured to operate the system in a first state in which:

the first blender unit delivers the first fluid to a first set of pumpers of the fleet of pumpers;

the second blender unit delivers the second fluid to a second set of pumpers of the fleet of pumpers; and the pump delivers the third fluid to a third set of pumpers of the fleet of pumpers.

6. The system of claim 5, wherein:

the first fluid includes solid particulates; and the second fluid and the third fluid are clean fluids substantially free of solid particulates.

7. The system of claim 6, wherein based on a failure, the controller is configured to operate the system in a second state in which:

the second blender unit delivers a fourth fluid having solid particulates to at least one of the second set of pumpers; and the pump delivers the third fluid to the third set of pumpers.

8. The system of claim 1, further comprising:

a first proppant transport system configured to deliver proppant to the first tub;

a second proppant transport system configured to deliver proppant to the second tub; and one or more water tanks configured to deliver water to the pump.

9. The system of claim 1, further comprising:

the fleet of pumpers fluidly connected to a first well; and a fleet of second pumpers fluidly connected to a second well; and wherein:

the second blender unit and the pump are configured to be in communication with the fleet of second pumpers.

10. The system of claim 9, further comprising:

a controller configured to be in communication with the first blender unit, the second blender unit, and the pump;

wherein, the controller is configured to operate the system in a third state in which:

the first blender unit delivers the first fluid to a first set of pumpers of the fleet of pumpers;

the pump delivers the third fluid to a second set of pumpers of the fleet of pumpers;

the second blender unit delivers the second fluid to a first set of pumpers of the fleet of second pumpers; and the pump delivers the third fluid to a second set of pumpers of the fleet of second pumpers.

11. The system of claim 10, wherein:

the first fluid includes solid particulates;

the second fluid includes solid particulates; and the third fluid is a clean fluid substantially free of solid particulates.

12. The system of claim 11, wherein, based on a failure, the controller is configured to operate the system in a fourth state in which the second blender unit delivers the second fluid to the first set of pumpers of the fleet of pumpers and the first set of pumpers of the fleet of second pumpers.

13. The system of claim 1, wherein the pump includes one or more centrifugal pumps.

14. A method for blending liquid and solid particulates together in a split streaming operation, the method comprising:

operating a blender in a first state, in which:

a first fluid is pumped through a first blender unit of the blender to a first set of pumpers, the first blender unit having a first tub mixer, a first suction pump, a first discharge pump, and a plurality of first discharge ports, and a second fluid is pumped through a second blender unit of the blender to a second set of pumpers, the second blender unit having a second tub mixer, a second suction pump, a second discharge pump, and a plurality of second discharge ports, wherein the first fluid is not pumped through the second blender unit;

operating a pump in a first state, in which a third fluid is pumped to the second set of pumpers or to a third set of pumpers; and switching an operation state of the blender from the first state to a second state, in which the first fluid is pumped to at least one pumper of the second set of pumpers or the third set of pumpers.

15. The method of claim 14, wherein:

the first fluid includes a mixing fluid and solid particulates; and the second and third fluid are substantially free of solid particulates.

16. The method of claim 14, wherein the first set of pumpers is connected to a first well and the second set of pumpers is connected to a second well.

17. The method of claim 14, wherein the first set of pumpers and the second set of pumpers are connected to a first well.

18. The method of claim 14, wherein, while the blender is in the second state, the method includes: pumping the first fluid from the first tub mixer, to the second discharge pump, and to the plurality of second discharge ports.

19. The method of claim 14, wherein the pump includes one or more centrifugal pumps.

20. A hydraulic fracturing system, comprising:

a blender having:

a first blender unit disposed on a platform, the first blender unit having:

a first tub having a first mixer configured to mix fluid and solid particulates;

a first suction pump configured to deliver fluid to the first tub;

a first discharge pump configured to draw a first fluid from the first tub and discharge the first fluid from the first blender unit;

a second blender unit disposed on the platform, the second blender unit having:

a second tub having a second mixer configured to mix fluid and solid particulates;

a second suction pump configured to deliver fluid to the second tub;

a second discharge pump configured to draw a second fluid from the second tub and discharge the second fluid from the second blender unit; and a centrifugal pump configured to pump a third fluid; and a pumper having a first fluid end and a second fluid end; wherein:

the first fluid end is in fluid communication with the first blender unit; and the second fluid end is in fluid communication with the second blender unit or the centrifugal pump.

21. The hydraulic fracturing system of claim 20, further comprising a first set of plungers associated with the first fluid end and a second set of plungers associated with the second fluid end, wherein the first set of plungers have a stroke length less than a stroke length of the second set of plungers.

* * * * *